US011472149B2

(12) United States Patent
Rapparini et al.

(10) Patent No.: US 11,472,149 B2
(45) Date of Patent: Oct. 18, 2022

(54) METHOD AND MACHINE FOR MAKING FLEXIBLE PACKAGES WITH SIDE GUSSETS

(71) Applicant: ICA S.P.A., Bologna (IT)

(72) Inventors: Gino Rapparini, Bologna (IT); Pietro Crescimbeni, Bologna (IT)

(73) Assignee: ICA S.P.A., Bologna (IT)

( * ) Notice: Subject to any disclaimer, the term of this patent is extended or adjusted under 35 U.S.C. 154(b) by 53 days.

(21) Appl. No.: 17/053,090

(22) PCT Filed: May 7, 2019

(86) PCT No.: PCT/IB2019/053734
§ 371 (c)(1),
(2) Date: Nov. 5, 2020

(87) PCT Pub. No.: WO2019/215612
PCT Pub. Date: Nov. 14, 2019

(65) Prior Publication Data

US 2021/0138758 A1 May 13, 2021

(30) Foreign Application Priority Data

May 7, 2018 (IT) ..... 102018000005111

(51) Int. Cl.
*B31B 70/64* (2017.01)
*B31B 70/00* (2017.01)
(Continued)

(52) U.S. Cl.
CPC ..... *B31B 70/642* (2017.08); *B31B 70/005* (2017.08); *B31B 70/18* (2017.08);
(Continued)

(58) Field of Classification Search
CPC ... B31B 70/262; B31B 70/8132; B31B 70/36; B31B 70/642; B31B 70/18;
(Continued)

(56) References Cited

U.S. PATENT DOCUMENTS 3,554,822 A 1/1971 Schwarzkopf
3,976,418 A * 8/1976 Leathers ..... B29C 53/10 264/285
(Continued)

FOREIGN PATENT DOCUMENTS

DE 1629218 12/2001
EP 3 121 129 1/2017
(Continued)

OTHER PUBLICATIONS

International Search Report dated Nov. 9, 2019 in corresponding PCT application No. PCT/IB2019/053734, 2 pages.

*Primary Examiner* — Thomas M Wittenschlaeger
(74) *Attorney, Agent, or Firm* — Fattibene and Fattibene LLC; Paul A. Fattibene

(57) ABSTRACT

The present invention relates to a method for making packages (100) made of flexible material. The method comprises a first step which consists in providing a first strip (19) and a second strip (20) made of flexible material, positioned on top of each other along a conveying direction and preferably having the same width. Moreover, the method comprises a second step of securing the first strip (19) to the second strip (20) by means of a welding surface (24) which extends in a direction perpendicular to the conveying direction of the first and the second strip (19, 20) for a first length (h4) which is less than the width (h3) of each of the first and the second strip (19, 20); wherein the welding surface (24) is positioned at a first side edge (39) of the first and the second strip (19, 20). In addition, the present
(Continued)

invention also comprises a machine (200) which allows using such method.

14 Claims, 16 Drawing Sheets

(51) Int. Cl.

| | |
|---|---|
| ***B31B 70/18*** | (2017.01) |
| ***B31B 70/26*** | (2017.01) |
| ***B31B 70/36*** | (2017.01) |
| ***B31B 70/81*** | (2017.01) |
| ***B65D 30/20*** | (2006.01) |
| *B31B 155/00* | (2017.01) |
| *B31B 160/20* | (2017.01) |

(52) U.S. Cl.
CPC ..... *B31B 70/262* (2017.08); *B31B 70/36* (2017.08); *B31B 70/645* (2017.08); *B31B 70/8132* (2017.08); *B65D 31/10* (2013.01); *B31B 2155/002* (2017.08); *B31B 2155/0014* (2017.08); *B31B 2160/20* (2017.08)

(58) Field of Classification Search
CPC ..... B31B 70/005; B31B 70/645; B31B 2155/002; B31B 2155/0014; B31B 2160/20; B31B 2100/00; B65D 31/10
See application file for complete search history.

(56) References Cited

U.S. PATENT DOCUMENTS

| | | | | |
|---|---|---|---|---|
| 4,436,576 | A * | 3/1984 | Seiden | B29C 65/305 53/374.4 |
| 4,837,849 | A * | 6/1989 | Erickson | B29C 65/7437 383/114 |
| 6,030,123 | A | 2/2000 | Miarai | 383/63 |
| 6,425,847 | B1 * | 7/2002 | Broenstrup | B31B 70/10 493/197 |
| 2001/0053253 | A1 * | 12/2001 | Buchman | B65D 33/2516 493/213 |
| 2003/0165278 | A1 * | 9/2003 | Baker | B65D 33/002 53/459 |
| 2004/0258332 | A1 * | 12/2004 | Totani | B65D 31/10 383/120 |
| 2016/0129628 | A1 | 5/2016 | Nagata | B29C 65/18 |
| 2016/0229146 | A1 * | 8/2016 | Patel | B31B 70/266 |
| 2017/0021584 | A1 * | 1/2017 | Totani | B31B 70/645 |
| 2018/0370173 | A1 * | 12/2018 | Garriga Jimenez | B31B 70/00 |

FOREIGN PATENT DOCUMENTS

| | | |
|---|---|---|
| JP | H1059387 | 3/1998 |
| JP | H1128771 | 2/1999 |
| JP | 2003300263 | 10/2003 |
| JP | 2004010055 | 1/2004 |
| JP | 2005112385 | 4/2005 |
| JP | 2010208332 | 9/2010 |
| WO | WO 2015040631 | 3/2015 |
| WO | WO 2017/017298 | 2/2017 |

* cited by examiner

SEZ. A-A

METHOD AND MACHINE FOR MAKING FLEXIBLE PACKAGES WITH SIDE GUSSETS

TECHNICAL FIELD

The present invention relates to the field of sealable packages. More specifically, the present invention relates to the field of sealable packages made of flexible material having side gussets, which preferably further have reclosable openings. Moreover, the present invention relates to the field of machines for making sealable packages and a method for making such packages.

STATE OF THE ART

Packages made of flexible material are commonly used in various fields: from the food to the industrial field. Packages made of flexible material for example, are commonly used to contain flour, grated cheese or the like, or alternatively for storing animal food, such as kibble for dogs or for cats.

Such packages have various sizes according to the use made of such packages. In the case of pet food for example, such packages have also very large sizes to allow storing an increased quantity of food.

For this purpose, to allow an increase of material stored in the packages, front area of the package being equal, such packages are provided with side gussets which allow the package to extend in depth so as to allow a significant increase of the inner volume.

Such side gussets normally are an accordion structure, which most times is a simple sheet made of flexible material folded in half and placed at opposite ends of the front panel and of the back panel of the package so as to connect the front panel to the back panel.

An example of a method that allows making such packages is shown in Japanese Patent JP 3 733 085 B2 (hereinafter more simply called PTL1). As mentioned, PTL1 shows a method for making such packages. FIG. 13 of PTL1 shows that the tubular element 1, from which right and left side gussets of two successive packages are made, is conveyed between two layers of strip 2 which form the front panel and the back panel of the final package.

Once conveyed between the two strips 2, such tubular element 1 first is secured to the strips 2 by means of three seal spots 24 and then the two end portions of the tubular element are folded, at which slits 17 are positioned that allow the passage of the air. Indeed, PTL1 clearly shows the formation of an open, and therefore not sealable, package that allows the passage of air from the outside to the inside of the package by means of the slits 17.

As shown in FIG. 15 of PTL1, the folding is ensured by the folding means 22 and 25 which, by means of the cooperation thereof, allow having an end portion of the tubular element 1 having a pointed shape. Such pointed portion is formed by two right-angled triangles placed adjacent to each other. After such folding, the folding is secured by means of a forth seal spot 24.

As is apparent from the above description of PTL1, this system has several disadvantages, two of which are described here.

A first disadvantage is that the author of PTL1 has positioned the tubular element 1 between two strips 2 that are completely free to move with respect to each other. If on the one hand this solution might seem advantageous because it allows having more space to position the various sealers and the folding means between the two strips, on the other it implies a significant slowing down of the package forming process because an increased number of operations at the same point in space are to be performed for such purpose on the strips 2 and on the tubular element 1 before conveying the strip 2 towards a successive sub-station.

A second disadvantage is that there is an increased difficulty in achieving an increased accuracy in positioning the tubular element 1 with respect to the strips 2 in the system described in PTL1. This is because the increased number of components present therein and the simultaneous increased degree of freedom of the various components results in an increased level of difficulty in positioning the tubular element at a more accurate point of the strips 2 with a given accuracy.

For this reason, the author of the present invention has looked for a solution that would allow resolving such problems and would therefore provide a method and a machine capable of allowing an effective positioning of the tubular element with respect to the strips and would simultaneously allow achieving higher speeds for making packages with respect to that shown in PTL1.

SUMMARY

The present invention is based on the idea of making a welding surface that allows pre-securing the two strips so that the first strip and the second strip can be partially moved with respect to each other in the successive stations without however them being completely moved with respect to one another because they are already pre-secured.

According to a particular embodiment of the present invention, a method for making packages is provided, the method comprising the following steps:

a) providing a first strip and a second strip made of flexible material, positioned on top of each other along a conveying direction and preferably having the same width;

b) securing the first strip to the second strip by means of a welding surface which extends in a direction perpendicular to the conveying direction of the first and the second strip for a first length which is less than the width of each of the first and the second strip; the welding surface is positioned at the first side edge of the first strip and the second strip.

This solution is particularly advantageous because it allows pre-securing the two strips before the tubular element is introduced between the two strips. Indeed, having defined that the extension of the welding surface is less than the width of each of the first and the second strip clearly implies that such welding surface does not correspond to the one made for the actual closure of the package, rather corresponds to a pre-securing configured so as to pre-secure the two strips. Therefore, this pre-securing is particularly advantageous because it allows securing the two strips upstream and leaving free a portion of the strips for introducing the tubular element that forms the side gussets of the package. With respect to the background art, and more particularly with respect to PTL1, this solution is particularly advantageous because it allows both allowing an increased accuracy in the successive positioning of the tubular element and reducing the number of operations to be performed in the coupling station, while at the same time ensuring a sufficient space for introducing the tubular element. Moreover, due to such welding surface, it is possible to position the side gussets at a predetermined distance from the first side edge of the strips so as to have an upper portion of the final package free from gussets, thus allowing to apply a reclosable opening at such portion. In the same manner, if the two strips have the same width, it is possible to position the side edges of the two strips at each other so as to use such side edges of the strips as upper and lower edge of the final package.

According to a particular embodiment of the present invention, a method for making packages is provided, wherein a distance between two midpoints of two of the welding surfaces that are positioned consecutively along the conveying direction is equal to the width of the package, wherein the distance is measured along the conveying direction. This solution is particularly advantageous because it allows having welding surfaces that allow pre-securing the two strips that have a distance equal to the final package, thus allowing the welding surfaces to be "encompassed" in the side seals of the package. Therefore once the package is made, such welding surfaces are not visible from the outside, thus allowing to have a final product that is visually similar to the one that would be obtained without the presence of such welding surfaces.

According to a particular embodiment of the present invention, a method for making packages is provided, wherein an edge of the welding surface is positioned along the first side edge of the first and the second strip. This solution is particularly advantageous because it allows positioning such welding surface along an edge of the strips and leaving free the opposite edge so as to convey for example, the tubular element that serves to make the gussets at the other side edge of the strips.

According to a particular embodiment of the present invention, a method for making packages is provided, wherein the first length, along which the welding surface extends, is less than half the width of the first strip and the second strip, the first length preferably being comprised between 35 mm and 50 mm, more preferably the length is equal to 50 mm. Such solution is particularly advantageous because it allows having an upper portion of the final package free from gussets wherein such portion is less than half the axial extension of the package. Moreover, the above-indicated preferable range wherein the first length is comprised allows having an upper portion free from gussets equal to at least 35 mm. This contrivance allows for example, installing a reclosable opening at this area.

According to a particular embodiment of the present invention, a method for making packages is provided, wherein during step a), the first and the second strip are made from a third strip coming from reel, wherein the first and the second strip preferably are obtained by folding the third strip coming from reel along a fold line coinciding with the axis of the third strip so as to arrange the side edges of the third strip at one another and by cutting the third strip along such fold line. This solution is particularly advantageous because it allows having a single reel from which the two strips are obtained. This implies for example, being able to effectively reduce the sizes of the machine and replacing one reel alone, if it is used up. It is apparent that the term axis of the third strip here means the axis along which the third strip is unrolled and passing through the midpoint of the third strip.

According to a particular embodiment of the present invention, a method for making packages is provided, wherein the method further comprises the following step:

c) providing a reclosable opening between the first strip and the second strip so as to position the reclosable opening, along a direction parallel to the conveying direction, at a distance from the first edge that is less than the first length so as to secure the reclosable opening between the first strip and the second strip by means of the welding surface.

This solution is particularly advantageous because it allows effectively taking advantage of the welding surface that as mentioned, allowed pre-securing the two strips also to secure the reclosable opening between the first strip and the second strip, thus serving a dual purpose. This means that the reclosable opening is conveyed along a direction parallel to the one of the strips so as to effectively position such opening parallel to the upper edge of the package. Moreover, such reclosable opening preferably is provided from reel so as to be provided in continuous manner. Such reclosable opening preferably is a reclosable zipper length that is secured both to the front strip and to the back strip so as to secure a portion to each of the strips and thereby to ensure a closure of the final package. Indeed, by engaging the first portion of the reclosable opening with the second portion of the reclosable opening, it is possible to close the upper opening of the package after the package itself was opened the first time.

According to a particular embodiment of the present invention, a method for making packages is provided, wherein after the first strip is secured to the second strip by means of the welding surface, a second side edge of the first strip and a second side edge of the second strip, which are opposite to the first side edge, are moved away from each other so as to form an empty space between the first strip and the second strip, wherein the empty space extends from the second edge to the welding surface. This solution is particularly advantageous because it allows opening the first strip from the second strip without there being the risk for the two strips to move laterally with respect to each other because they were pre-secured as mentioned above, by the welding surface. Therefore, this opening allows moving the first strip away from the second strip along a side edge and therefore, conveying the tubular element that forms the side gussets of the package by means of such opening.

According to a particular embodiment of the present invention, a method for making packages is provided, wherein the method further comprises the following step:

d) conveying a tubular element that forms side gussets of the package into the empty space until an end portion of the tubular element reaches a first distance from the first side edge, wherein the first distance is greater than or equal to the first length; wherein the tubular element preferably is conveyed along a direction perpendicular to the conveying direction of the first and the second strip.

This solution is particularly advantageous because it allows using the space formed between the two strips to introduce the tubular element itself, which as mentioned, forms the side gussets of the package. As is apparent from what is described, this solution allows uncoupling the point wherein the welding of the welding surface occurs and the point wherein the tubular element is inserted, due to the provision of the above-described welding surface. This has allowed the inventor to allow an actual reduction of the production times of a single package. Moreover, the fact that the first distance is greater than or equal to the first length allows positioning the tubular element at the bottom with respect to the welding surface, thus allowing to have a package having an upper portion free from gussets.

According to a particular embodiment of the present invention, a method for making packages is provided, wherein the tubular element is made by folding a sheet made of flexible material along two mutually parallel first fold lines so as to form the tubular element, and by folding an end portion of the tubular element along two second fold lines that are oblique with respect to the direction of the two first fold lines so as to form an end portion of the tubular element that has two triangular portions having two mutually parallel sides. This solution is particularly advantageous because it allows obtaining side gussets having an inclined surface. Moreover, this solution allows providing such empty space with an already "ready" tubular element without the need to perform the various folding operations in such empty space. This therefore allows significantly reducing the time for producing the packages.

According to a particular embodiment of the invention, a method for making packages is provided wherein, after the tubular element is conveyed into the empty space between the first strip and the second strip, the tubular element is secured to the first strip and to the second strip by means of a second welding surface. This solution is advantageous because it allows securing together all the elements, thus effectively avoiding a movement that could occur between the various components. In this manner, it is thus possible in a successive step to convey the two strips without the tubular element portion moving with respect thereto.

According to a particular embodiment of the present invention, a method for making packages is provided, wherein the packages are sealable packages. This implies that the package allows sealing the atmosphere inside the package with respect to the atmosphere outside the package, for example by allowing the organoleptic properties of the material contained in the package to be kept.

According to an embodiment of the present invention, a machine for making packages made of flexible material is provided; the machine comprises a preparing station configured so as to provide a first strip and a second strip positioned on top of each other along a conveying direction; wherein the preparing station comprises first welding means configured so as to make a welding surface which extends in a direction perpendicular to the conveying direction of the first and the second strip for a first length which is less than the width of each of the first and the second strip; the welding surface is positioned at a first side edge of the first and the second strip. This solution is particularly advantageous because it allows pre-securing the two strips before the tubular element is introduced between the two strips due to the first welding means. Indeed, having defined that the extension of the welding surface is less than the width of each of the first and the second strip clearly implies that such welding surface does not correspond to the one made for the actual closure of the package, rather corresponds to a pre-securing configured so as to pre-secure the two strips. Therefore, this pre-securing is particularly advantageous because it allows securing the two strips upstream and leaving free a portion for introducing the tubular element that forms the side gussets of the package. With respect to the background art, and more particularly with respect to PTL1, this solution is particularly advantageous because it allows both allowing an increased accuracy in the successive positioning of the tubular element and reducing the number of operations to be performed in the coupling station, while at the same time ensuring a sufficient space for introducing the tubular element. Moreover, due to such welding surface, it is possible to position the side gussets at a predetermined distance from the first side edge of the strips so as to have an upper portion of the final package free from gussets, thus allowing to apply a reclosable opening at such portion. In the same manner, if the two strips have the same width, it is possible to position the side edges of the two strips at each other so as to use such side edges of the strips as upper and lower edge of the final package.

According to a further embodiment of the present invention, a machine for making packages made of flexible material is provided, wherein the first length is less than half the width of the first strip and the second strip, the first length preferably being comprised between 35 mm and 50 mm, more preferably the length is equal to 50 mm. Such solution is particularly advantageous because it allows having an upper portion of the final package free from gussets wherein such portion is less than half the axial extension of the package. Moreover, the above-indicated preferable range wherein the first length is comprised allows having an upper portion free from gussets equal to at least 35 mm. This contrivance allows for example, installing a reclosable opening at this area.

According to a further embodiment of the present invention, a machine for making packages made of flexible material is provided, wherein the preparing station further comprises folding means configured so as to fold a third strip coming from reel along a fold line that coincides with the axis of the third strip so as to arrange the side edges of the third strip one at the other, and cutting means configured so as to cut a third strip along the fold line so as to allow obtaining the first and the second strip. This solution is particularly advantageous because it allows having a single reel from which the two strips are obtained. This implies for example, being able to effectively reduce the sizes of the machine and replacing one reel alone, if it is used up. It is apparent that the term axis of the third strip here means the axis along which the third strip is unrolled and passing through the midpoint of the third strip.

According to a further embodiment of the present invention, a machine for making packages made of flexible material is provided, wherein the preparing station further comprises second welding means configured so as to seal a reclosable opening at the first and the second strip, the second welding means being positioned at the first edge along a direction parallel to the conveying direction. This solution is particularly advantageous because it allows welding the reclosable opening to each of the two strips along the direction wherein the reclosable opening extends. Moreover, such reclosable opening preferably is provided from reel so as to be provided in continuous manner. Such reclosable opening preferably is a reclosable zipper length that is secured both to the front strip and to the back strip so as to secure a portion to each of the strips and thereby to ensure a closure of the final package. Indeed, by engaging the first portion of the reclosable opening with the second portion of the reclosable opening, it is possible to close the upper opening of the package after the package itself was opened the first time.

According to a further embodiment of the present invention, a machine for making packages made of flexible material is provided, wherein the welding surface allows securing the reclosable opening in a side area of the package. This solution is particularly advantageous because it allows effectively taking advantage of the welding surface that as mentioned, allowed pre-securing the two strips also to secure the reclosable opening between the first strip and the second strip, thus serving a dual purpose. This means that the reclosable opening is conveyed along a direction parallel to the one of the strips so as to effectively position such opening parallel to the upper edge of the package. Moreover, this solution also allows flattening a side portion of the reclosable opening, therefore decreasing the thickness resulting therefrom.

According to a further embodiment of the present invention, a machine for making packages made of flexible material is provided, wherein the second welding means are positioned upstream of the first welding means. This solution is particularly advantageous because it allows inserting an element, such as a contrast element, between the two welding means so as to allow the continuous opening of the reclosable opening after it is coupled to the front and back strip.

BRIEF DESCRIPTION OF THE DRAWINGS

The present invention is described with reference to the accompanying drawings wherein the same reference numbers and/or marks indicate the same parts and/or similar parts and/or corresponding parts of the system.

FIG. 5A shows a detail of a second station of the machine described in FIG. 3, wherein there is formed a tubular element according to a particular embodiment of the present invention, while FIG. 5B shows a section view of the tubular element 61 taken along the cutting line A-A in FIG. 5A.

FIG. 6A shows a detail of the tubular element forming station, more specifically it shows the system for moving the tubular element and for forming the fold lines that are oblique with respect to the axis of the tubular element, while FIG. 6B shows a section view taken along the cutting line A-A shown in FIG. 6A.

DETAILED DESCRIPTION

Figure 1:
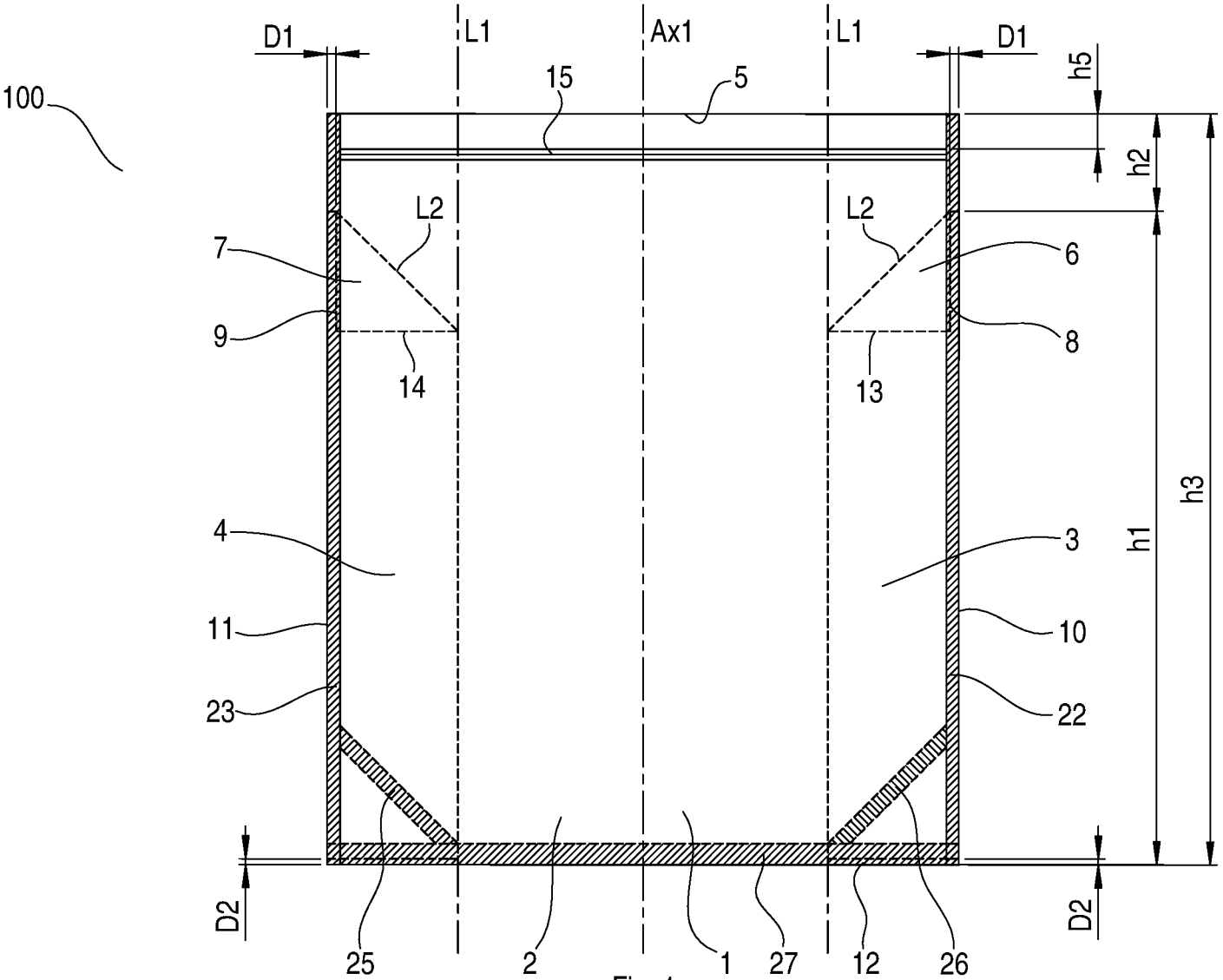
FIG. 1 shows a front view of a package made of flexible material according to an embodiment of the present invention.

The present invention is described hereinbelow by making reference to particular embodiments, as illustrated in the accompanying drawings. However, the present invention is not limited to the particular embodiments described in the following detailed description and depicted in the drawings, rather the embodiments described simply exemplify the various aspects of the present invention, the scope of which is defined by the appended claims. Further modifications and variations of the present invention will be apparent to those skilled in art.

Reference is made to the plane on which the sealable package 100 rests when reference in the present description is made to the terms "right", "left", "top", "bottom", "front" and "back". Therefore, the plane on which the sealable package 100 rests is a plane which is at the opposite side with respect to the one wherein the opening of the package is positioned. Therefore, the term "top" means a portion of the package placed at the opening of the package, through which the contents of the package may be inserted. Moreover, with respect to the plane on which the package 100 rests, right refers to the right side of the reader and similarly, left refers to the left side of the reader; finally, front is the portion of package facing the side of the reader and similarly, back refers to the opposite side with respect to the reader.

The term conveying direction in the present invention means a direction along which the package 100, or parts thereof, is made. In this logic, if one process is performed "downstream" with respect to another, it means that during the process leading to making the package 100, such process is performed after another process was performed. In the same manner, if one process is performed "upstream" with respect to another, it means that during the process leading to making the package 100, a process is performed before another process was performed.

FIG. 1 diagrammatically illustrates a sealable package 100 according to an embodiment of the present invention.

FIG. 1 shows a front view of the package 100; in particular, the upper opening 5 of the package is positioned at an upper end of the drawing, while the lower edge 12 of the package 100 is positioned in the lower part of the drawing.

The package 100 is sealable because, as will be apparent from the following description, after filling the package 100 through the upper opening 5 and having made, at such opening 5, a welding surface adapted to close the opening of the package, it will be impossible for the atmosphere outside the package to enter the package. Therefore, the environment inside the package 100 will be completely isolated with respect to the external environment of the package 100.

The details of the package 100 described in FIG. 1 are now described, which will be apparent in the continuation of the description when the method for making the package is explained with reference to the following drawings.

The sealable package 100 made of flexible material comprises a front panel 1 and a back panel 2. The front panel 1 and the back panel 2 are connected by two side gussets: a right side gusset 3 and a left side gusset 4. Such side gussets 3, 4 are provided at opposite ends of the front panel 1 and of the back panel 2. The two side gussets 3, 4 comprise a sheet folded along a fold line L1 that is parallel to the axis Ax1 of the package. In this manner, an accordion structure is formed which allows increasing the distance between the front panel 1 and the back panel 2.

Clearly, it is also possible for the side gussets 3, 4, to comprise more than one fold line so as to significantly increase the distance between the two panels, and therefore significantly increase the volume of the package.

The front panel 1, the back panel 2 and the two side gussets 3, 4 preferably are made of sheets made of flexible and sealable material. Such sheets preferably are sealable only on one of the two surfaces.

For this reason, the front panel 1 and the back panel 2 have the sealable surfaces facing the inside of the package 100. In the same manner, the side gussets 3 and 4 have sealable surfaces facing the inside of the package 100. In particular, the side gussets 3, 4 have sealable surfaces facing the front panel 1 and the back panel 2 so as to allow a seal between the side gussets 3, 4 and the front and back panels 1, 2, so as to allow a side closure of the package 100 to be ensured.

As shown in the drawing, the package has a reclosable opening 15 positioned at an area close to the opening 5 of the package 100. Such reclosable opening 15 preferably extends along a direction perpendicular to the axis Ax1 of the package 100. Moreover as described later, the reclosable opening is comprised between the side welding surfaces 22, 23. An example of reclosable opening is given by a zipper which allows reversibly opening and closing such package 100. The reclosable opening 15 therefore extends between the front panel 1 and the back panel 2: a first portion of the reclosable opening 15 is installed on the inner surface of the front panel 1 of the package 100, while a second portion of the reclosable opening 15 is installed on the inner surface of the back panel 2 of the package 100. In this manner, the first portion can be engaged with the second portion so as to ensure the closure of the package 100 also after the package 100 has been opened for the first time.

An upper end portion of the side gussets 3 and 4 is folded along a fold line L2 which is inclined with respect to the axis Ax1 of the package 100. The portion folded along the fold line L2 therefore is an end portion of each side gusset 3, 4 which is in the vicinity of the opening 5 of the package 100.

The formation of triangular portions 6 and 7 of the side gussets 3 and 4 results from folding the end portion of the side gussets 3,4, and therefore the possibility of having an upper portion of the package 100 free from gussets. This allows positioning the reclosable opening 15 in the area where there are only two layers of material (area having two thicknesses): the layer of the front panel 1 and the layer of the back panel 2.

The triangular portions 6, 7 have the shape of a right-angled triangle having a hypotenuse that is inclined with respect to the axis Ax1 of the package and wherein the vertex of each triangular portion 6, 7, which is higher in the package 100, is positioned in a side area of the package at which the seal is made (which is further explained later), which allows joining the front panel 1 to the back one 2 with the side gussets 3, 4 comprised therebetween.

Each of the two triangular portions 6, 7 therefore has a cathetus 8, 9 parallel to the outer edge 10, 11 of the package and another cathetus 13, 14 perpendicular to the outer edge 10, 11 of the package 100.

As shown in the drawing, each cathetus 8, 9 parallel to the outer edge 10, 11 of the package is positioned at a predetermined distance D1 from the outer edge of the package. As will be more apparent later when the method for making the package 100 is explained, this allows welding the front panel 1 to the gussets 3, 4 and then to the back panel 2, therefore "trapping" each triangular portion 6, 7. This therefore allows ensuring an effective sealing of the environment inside the package with respect to the external environment.

Contrarily, if the cathetus 8, 9 were positioned so as to overlap the edge 10, 11 of the package 100, the risk would exist of not having a perfect seal of the package 100 with respect to the outside. Moreover, there would also be the problem of the formation of a kind of "side tab" placed at the upper portion of the gusset, which would in some manner risk breaking, therefore resulting in a particularly weak and fragile package.

As is shown in the drawing and as mentioned above, side seals 22, 23 are made at the right 10 and left 11 side edges of the package, said seals allowing to close the package 100 along the right side and the left side. Such seals 22, 23 extend along the whole height h3 of the package. The width of such seals is greater than the above-described predetermined distance D1.

In this manner, a portion of the cathetus 13 and 14 overlaps the side welding area 22 and 23, thus ensuring the securing of the triangular portion 6 and 7 to the edge by "trapping it".

As mentioned, the width of the welding surface 22 and 23 is greater than the first predetermined distance D1 so as to allow "trapping" the triangular portion between the front panel 1 and the back panel 2. In particular, such predetermined distance D1 may preferably be greater than or equal to 1 mm, and in certain cases, also have larger sizes. For larger packages for example, the distance D1 preferably is greater than or equal to 4 mm. It is apparent that such distance strongly depends on the sizes of the package. For example, smaller packages have a smaller distance D1. Vice versa, larger packages have a larger distance D1. In the same manner, the distance D1 depends on the width of the side welding surfaces 22 and 23. To this end, the wider such surfaces, the greater the distance D1.

In addition as shown in the drawing, a lower welding surface 27 adapted to close the bottom of the package 100 so as to prevent the material contained in the package to come out from the bottom, is positioned along the lower edge 12 of the package 100. Furthermore, there are two welding surfaces 25 and 26 that are inclined with respect both to the welding surface 22 and 23 and to the welding surface 27 to allow effectively emptying the package and at the same time strengthening the lower edges. The effective emptying is due to the fact that the welding surfaces 25 and 26 allow having a bottom of the package that is flat, and therefore easier to empty.

This contrivance allows the material contained in the package 100 to effectively exit, which otherwise could be trapped at the lower corners of the package 100. Indeed, it is the object of the welding surfaces 25 and 26 to also reduce the possibility of part of the contents of the package to remain trapped at the lower edges.

For example, in the case wherein the value of the material contained in the package is particularly high, for example in the case of food products, there would be a serious waste which in any case is to be reduced.

Moreover, the side gussets 3 and 4 are positioned at a predetermined distance D2 with respect to the lower edge 12 of the package 100. This is due to the fact that in this manner, the lower portion of the gussets may be "trapped" between the front panel 1 and the back panel 2. Such distance D2 may vary according to the size of the package 100. As an indicative value, such distance preferably is greater than or equal to 1 mm. Moreover, most of the time such distance preferably is less than 5 mm.

Packages like the ones shown in FIG. 1 may have a wide range of sizes. For example, they may have a size that varies from relatively small packages, configured so as to contain 0.1 kg of material, to much larger packages, that allow containing up to 20 kg of material.

Summarizing therefore, the right side gusset 3 and the left side gusset 4 extend along the side edge 10, 11, of the package up to a height h1 from the lower edge 12 of the package 100. Therefore as shown in the drawing, the height h3 of the package 100 is equal to the sum of the distance h2 of the upper end portion of the gussets 3, 4 up to the upper edge 5, with the distance h1. Such gussets 3, 4 are positioned at the predetermined distance D2 with respect to the lower edge 12 of the package 100 which therefore is represented by the lower edge of the front panel 1 and of the back panel 2. Moreover, the upper end portion of the right 3 and left 4 side gusset is positioned at a distance h2 of the opening 5 of the package 100. This allows having an inner portion of the package 100 free from gussets and therefore also an effective exit of the material contained in the package 100.

With reference to FIGS. 2 to 16, a machine 200 for making packages 100 like the ones in FIG. 1 and a method for making such packages 100, are described.

Figure 2:
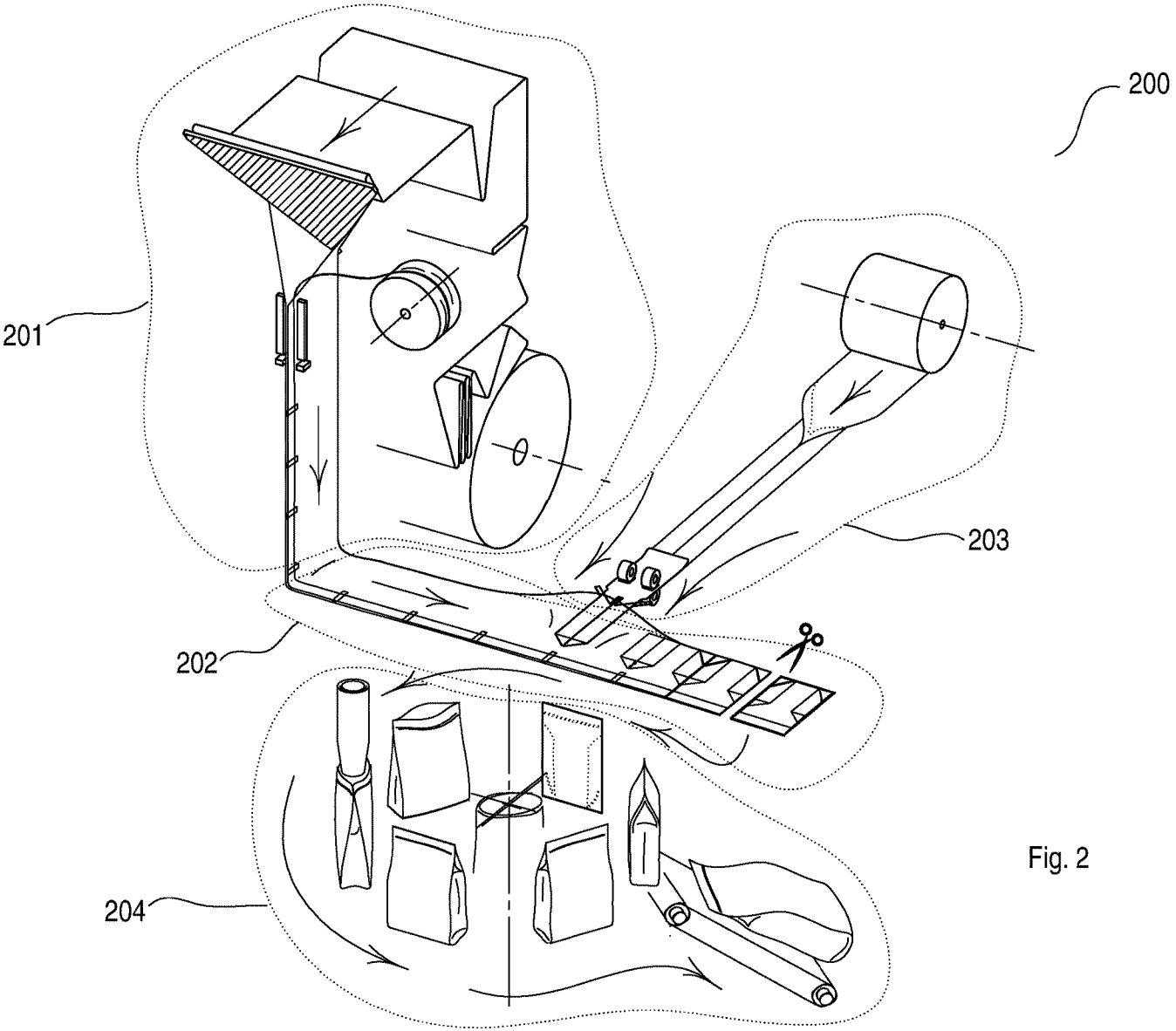
FIG. 2 shows a three-dimensional schematic view of a machine for making a package shown in FIG. 1, according to a particular embodiment of the present invention; wherein the dotted lines show ideal separation lines between the different stations of the machine.

FIG. 2 shows a machine 200 according to an embodiment of the present invention. The machine 200 shown in the drawing comprises four stations. A first station 201 is configured so as to prepare a strip of material which is then coupled in station 202 with the tubular element coming from the station 203. The station 203 is then configured so as to form the side gussets 2 and 3 of the package 100, which are shown in FIG. 1. Downstream of the coupling station 202, there is positioned a packaging station 204 wherein the package produced in the coupling station 202 is opened, filled with the contents of the package and finally closed at the opening 5 of the package 100 so as to seal the environment inside the package with respect to the external environment.

Figure 3:
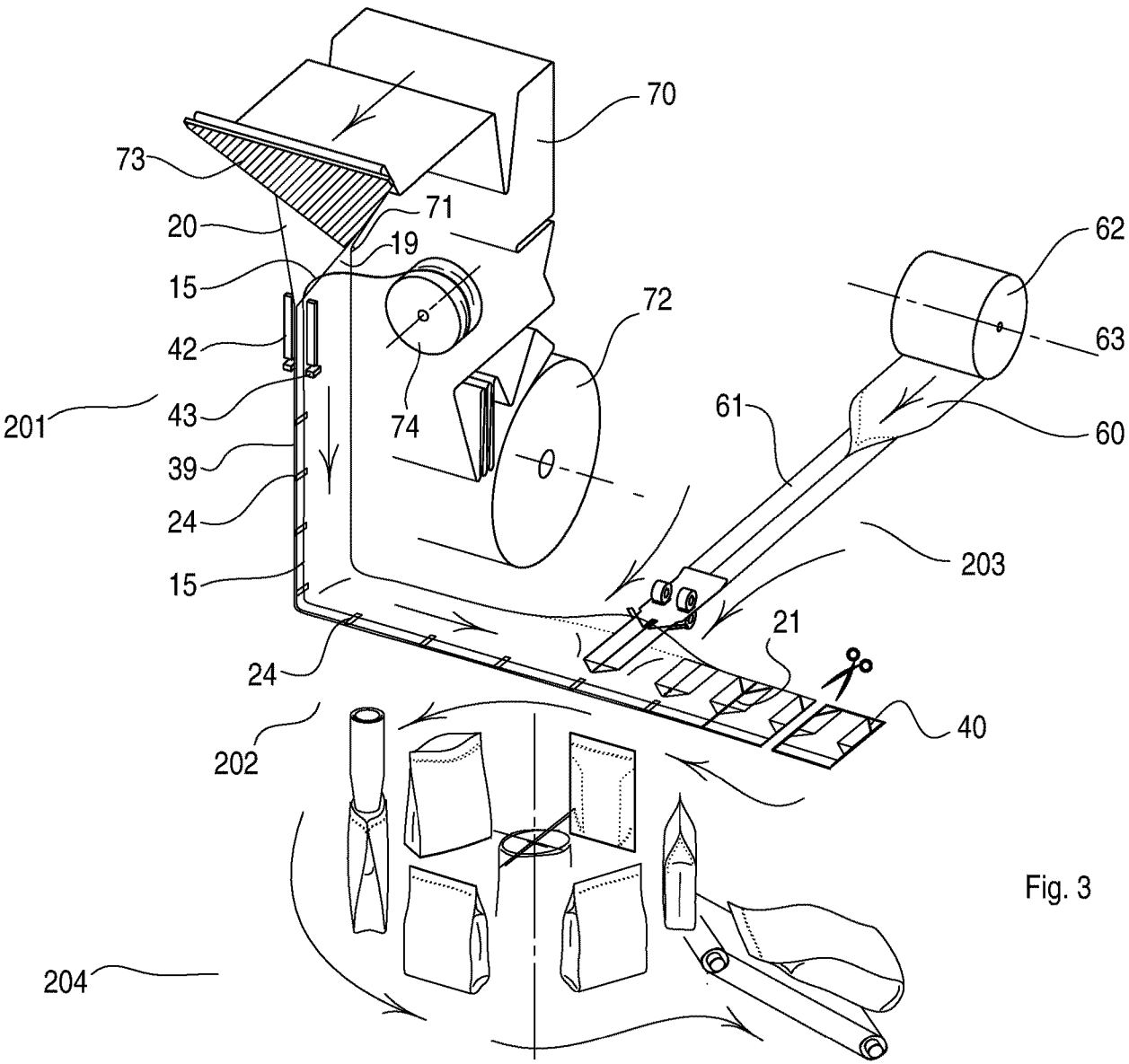
FIG. 3 more specifically shows the various components of the machine for producing packages depicted in FIG. 2, according to a particular embodiment of the present invention.

With reference now to FIG. 3, the preparing station 201, which is a vertical station in the particular example depicted in the drawing, the coupling station 202 and the tubular element forming station 203, are described in detail.

The method for making the package 100 will be apparent from the description of the various stations of the machine 200 and of how such stations contribute to making the package 100.

The preparing station 201 comprises a reel 72 on which a sheet 70 made of flexible material is wound, which as mentioned above, is sealable on one of the two sides.

The sheet 70 is unrolled from the reel 72 and conducted towards a forming device 73 which allows bending the sheet in half so as to form a folded sheet having a width equal to half the width that the sheet 70 had when it was positioned on the reel 72.

As mentioned, the sheet 70 is unrolled from the reel 72 and conveyed along the conveying direction indicated by the arrow in FIG. 3 towards the forming device 73, where it is folded. A blade 71 is positioned immediately downstream of the forming device 73, which blade allows cutting the sheet 70, therefore dividing it into two equal parts along the fold line that was provided by the forming device 73.

Therefore, downstream of the blade 71, there will be two sheets 19, 20 placed on top of each other that can be conveyed downstream. The sheets 19, 20 have the sealable surfaces facing each other while the outer surfaces are not sealable, thus allowing the two sheets to be sealed to each other.

Alternatively, it is obviously also possible to replace the above-described system with two reels configured so as to provide the two sheets 19, 20 positioned on top of each other. For example, this alternative system could be preferred in the case it is preferred to have two sheets having different properties, such as for example, colour and thickness. However as is apparent, this latter system has the disadvantage of having two reels and therefore of requiring a greater volume.

A reel 74 is placed downstream of the blade 71, on which reel a zipper length 15 is wound, which may be used as reclosable opening of the package 100.

Thus, the zipper length 15 is unrolled from the reel 74 and coupled to both sheets 19, 20 produced downstream of the blade 71. For example, in the particular example depicted in the drawing, the zipper length 15 is coupled to the front sheet 19 and the back sheet 20 by means of welding bars 42 which allow welding the reclosable opening 15 to what will be the panels 1, 2 of the package 100.

As shown in the drawing, the reclosable zipper 15 is provided from reel 74 and is coupled both with the front sheet and with the back sheet by means of the seal provided by the welding bars 42. In particular, after the reclosable opening 15 is opened, that is after a first portion of the reclosable opening 15 is uncoupled from a second portion of the reclosable opening 15, the first portion of the reclosable opening 15 is constrained to the front sheet 19 and the second portion to the back sheet 20. Thus, it is effectively possible to reversibly open/seal the package 100 by means of a successive uncoupling/coupling of the first portion from/to the second portion.

Thus as mentioned, the reclosable zipper 15, which comprises such first and second portion, is conveyed into the portion comprised between the sheet 19 and the sheet 20 and is sealed thereto. Such portions preferably are then uncoupled from each other, after the welding has been performed by means of the welding bars 42.

Thus, a contrast element (not shown in the drawing) with the purpose of separating the first portion of the reclosable opening 15 from the second one preferably is positioned downstream of the welding bars 42.

In this manner, as seen in the continuation of the description, it is preferable to have the two portions of the zipper 15 uncoupled from each other in the final station where the various packages 100 are separated from one another so as to allow the package 100 to be filled without the need to first uncouple the two portion so as to provide the package with an opening for filling the same.

Welding grippers 43 are placed downstream of the welding bars 42, which as mentioned, are configured so as to longitudinally seal the zipper 15, the welding grippers allowing to make welding surfaces 24 along a direction perpendicular to the conveying direction of the sheets 19 and 20. In the case wherein there is the above-described contrast element, it is between the welding bars 42 and the welding grippers 43.

These welding surfaces 24, which are introduced in greater detail with reference to the following drawings, allow securing the front sheet 19 to the back sheet 20 with the reclosable opening 15 comprised between such sheets 19, 20. Moreover, it is possible to flatten the zipper 15 at such welding surfaces 24 in order to reduce the thickness thereof. This then allows facilitating the side seals of the package, which are described later.

Each welding surface 24 produced by the welding grippers 43 is positioned close to the edge of the sheets 19 and 20. The term "close to" here means that there may also be a given distance between the edge of the sheets 19 and 20 and such welding surface 24, which is due for example, to margins of error required when positioning the welding grippers 43. In any case, it is preferable for such welding surface to be positioned next to the edge of the sheets 19, 20.

The closing surface, which then is the upper edge of the package 100 at which the opening 5 of the package 100 is positioned, extends along a direction parallel to the edge of the sheets 19, 20, i.e. longitudinal to the conveying direction of the sheets 19, 20. It therefore is apparent that given that the distance (see distance M1 in FIG. 13) between two consecutive midpoints of welding surfaces 24 is measured along the conveying direction of the sheets 19, 20, it is equal to the width of the package 100 that is then formed.

The length h4 (shown in FIG. 10) of such welding surfaces 24 preferably is comprised between 35 mm and 50 mm. According to a particular embodiment, such extension preferably is equal to 40 mm. In any case, the above-mentioned extensions strongly depend on the height of the final package 100 and therefore on the width of the sheets 19, 20 which as described later, coincides with the longitudinal extension h3 of the package.

It is important for such welding surfaces 24 to have a length which as described later, allows introducing a tubular element that will form the side gussets 3, 4. Thus, the higher the height h4, the larger is the portion of the package that is free from gussets. Therefore, in the case wherein the length h4 is equal to 40 mm, the portion of package free from side gussets will have an axial extension equal to at least 40 mm, preferably equal to 50 mm. This is because the tubular element cannot move close to the edge of the sheets 19, 20 at which the opening 5 of the package 100 is positioned, as described later.

The sheets 19 and 20 are conveyed downstream of the welding grippers 43 in downstream direction by means of the aid of movement elements (not shown in the drawing), which for example, are simple rollers. The procedure used by the preparing station 201 is shown in greater detail with reference to FIG. 4.

Figure 4:
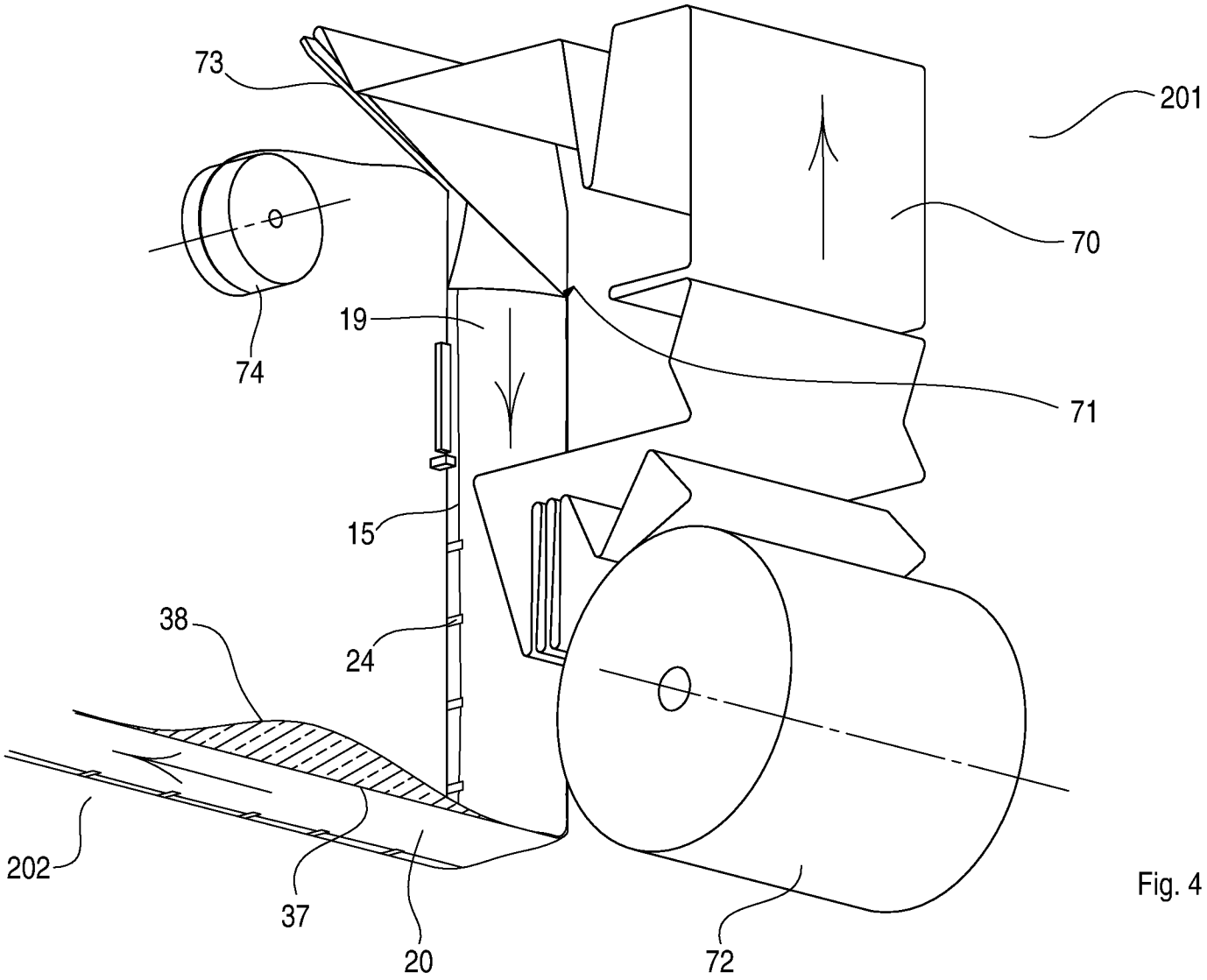
FIG. 4 shows a detail of a first station of the machine described in FIG. 3.

FIG. 4 clearly shows how the front sheet and the back sheet 19 and 20, at a given distance downstream of the portion where the welding surfaces 24 are made, are separated from each other along an edge 37, 38 that is opposite to the edge along which the above-described welding surfaces 24 are made. Such procedure may be performed by means of a simple protruding element (not shown in the drawing), known from the prior art (and simply called separating means hereinafter), which is configured so as to be inserted between the sheets 19, 20 and to increase the distance between the front sheet and the back sheet 19 and 20 so as to allow the insertion of the tubular element 61. Such separating means may then be represented by any system known from the prior art and capable of separating two sheets placed on top of each other and of forming an empty space therebetween, such as for example shown in WO 2015/040631 A1.

The edge 37 of the back sheet 20 and the edge 38 of the front sheet 19 therefore are positioned at the one which forms the lower edge 12 of the package 100.

Returning again to FIG. 3, the coupling station 202 is positioned downstream of such first preparing station 201, the coupling station being configured so as to couple the sheet 19 and the sheet 20 coming from the first station 201 with the tubular element 61 coming from the tubular element forming station 203, which is described later.

Therefore, the operating method of the tubular element forming station 203 that provides the tubular element to the coupling station 202 is described in detail before getting into the description of the coupling station 202.

As shown in FIG. 3, the conveying direction of the tubular element 61 is perpendicular to the conveying direction of the front sheet 19 and of the back sheet 20 described above.

Figures 5A, 5B:
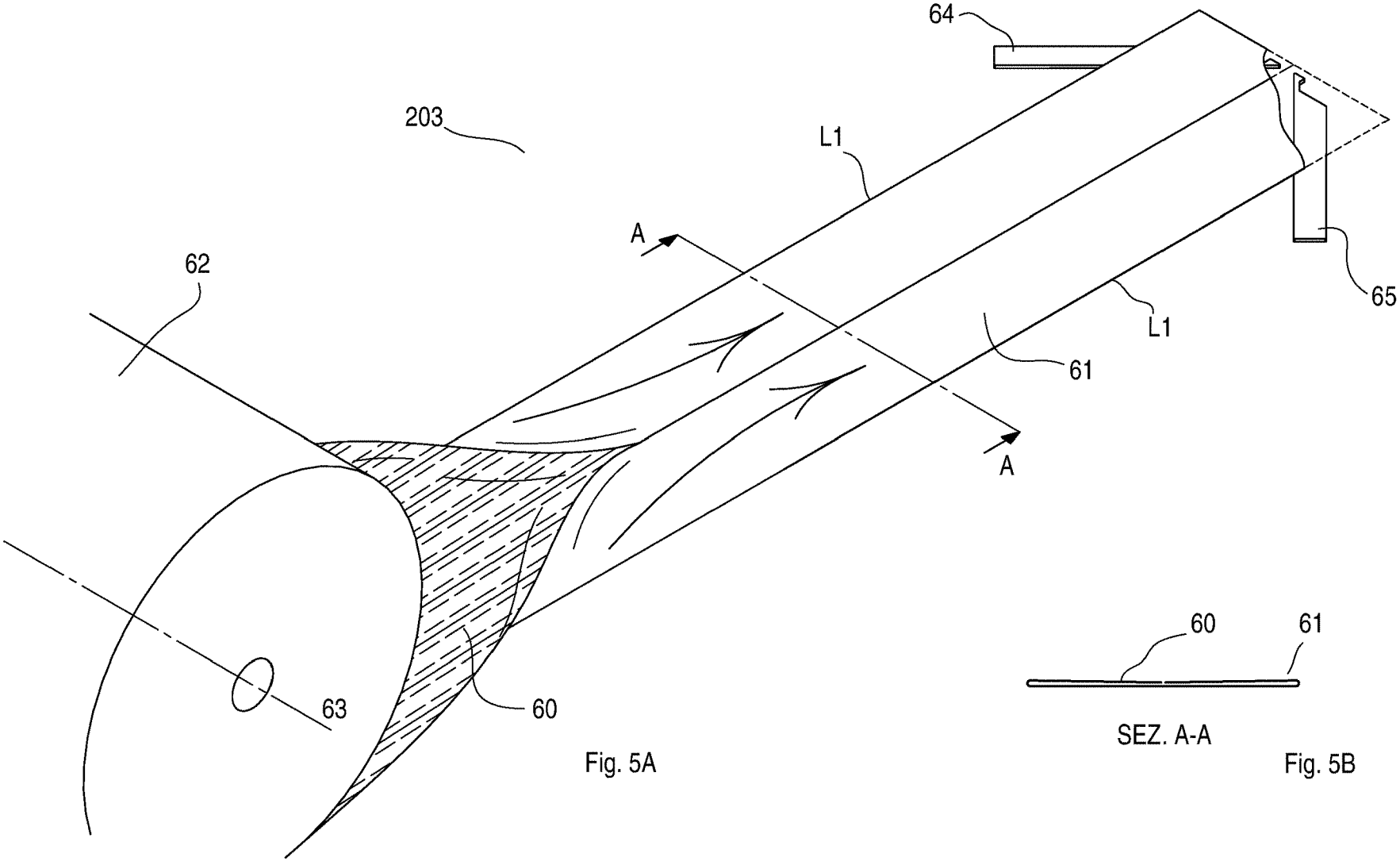

With reference to FIGS. 5A and 5B, the method with which such tubular element is made is described in detail. As shown in the drawing, a sheet 60 is rolled along a reel 62 configured to rotate about an axis 63. By rotating the reel 62, the sheet 60 is unrolled and the tubular element 61 is formed with the aid of a commonly known forming device (not shown in the drawing).

Tubular element means a sheet having a flattened tube structure that extends along a direction. The tubular element is formed from a sheet through two mutually parallel fold lines L1. As shown in the drawings, the two fold lines L1 allow moving the outer edges of the sheet 60 closet to each other so that the right edge of the sheet is positioned at the left edge of the sheet. The point wherein the right edge of the sheet meets with the left edge of the sheet coincides with the midpoint of the tubular element. The fold lines L1 indeed are arranged at the same distance with respect to the outer edges of the sheet 60.

An example of the structure having tubular element 61 is clearly shown in the section view A-A in FIG. 5B. Such drawing shows the fact that the tubular structure 61 has a lower edge that is continuous, while an upper edge has a slight discontinuity. The reason for the discontinuity lies in the fact that as described above, the upper edge of the tubular element 61 comprises the right edge of the sheet 60 and the left edge of the sheet 60 placed at each other. Therefore, there is a central portion of the upper edge of the tubular element 61 that represents a transition portion between the left edge and the right edge of the sheet 60.

In any case, the forming device that folds the sheet 60 along the fold lines L1 allows positioning the outer edges of the sheet 60 at each other so as to substantially make such discontinuity zero. It is worth noting that for illustrative purposes, such distance between the left and right edges is rather accentuated in FIG. 5B so as to allow the reader to understand that it is a tubular element and that the portion where there is such discontinuity is the portion where the right edge and the left edge of the sheet 60 meet. In reality, it is apparent that the area of discontinuity provided by the forming device is much less apparent.

Figures 6A, 6B:
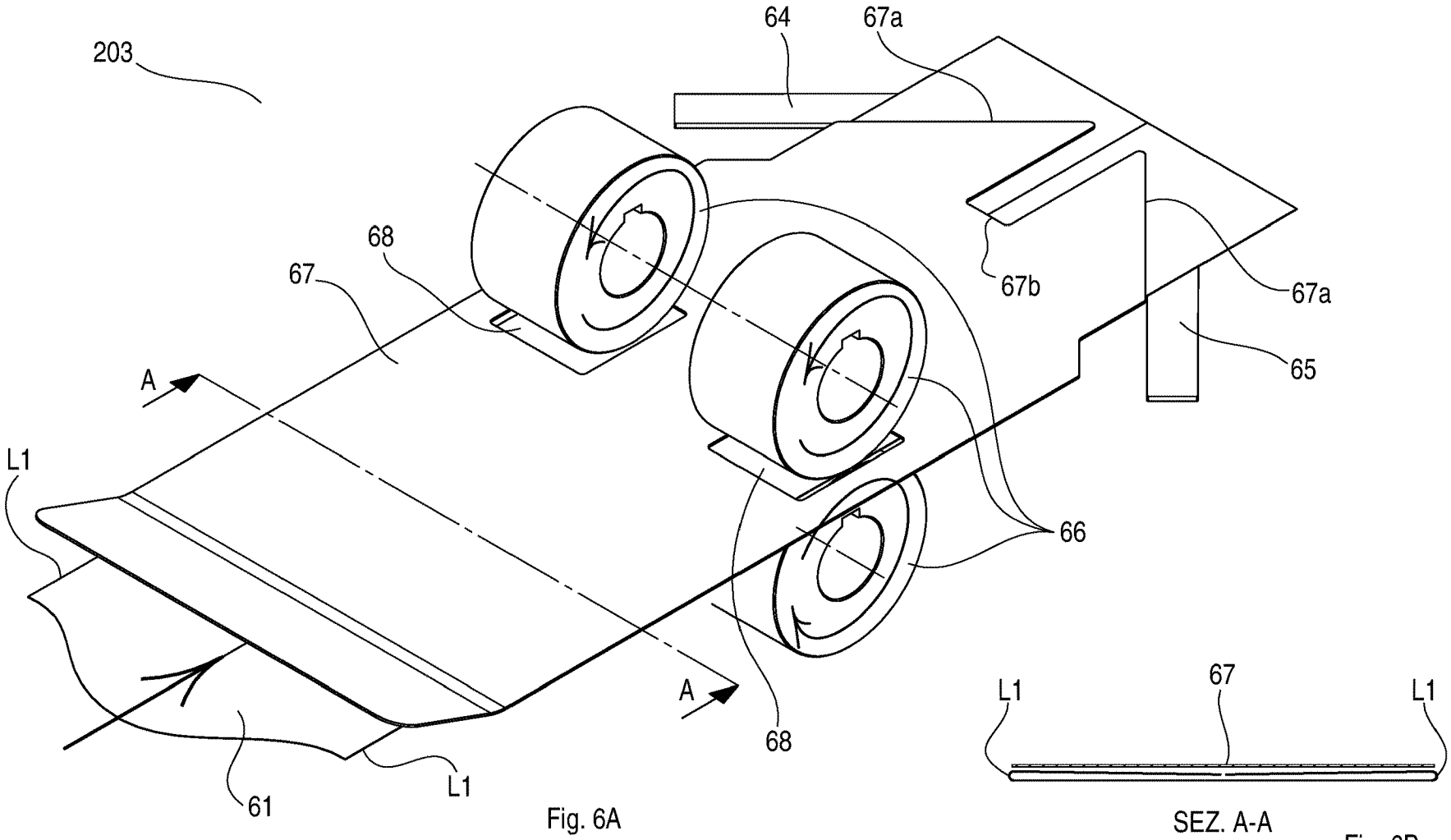

With reference to FIGS. 6A and 6B, they show the elements that allow the tubular element 61 to be folded and conveyed.

In particular, FIG. 6A shows that the conveying of the tubular element 61 along a direction perpendicular to the conveying direction of the sheets 19 and 20 shown in FIG. 3, is ensured by counter-rotating rollers 66 placed at two different levels.

The tubular element 61 is conveyed below a plate 67 on which there are provided two openings 68 which allow the counter-rotating rollers 66 to directly contact the tubular element and to convey it along a conveying direction by means of the rotation thereof. In the particular example shown in the drawing, given that the number of openings 68 is equal to two, the number of rollers is therefore equal to four.

However, it also is possible to increase or decrease the number of openings 68, and therefore of rollers 66, as desired according for example, to the sizes of the tubular element 61 or also for example, to the thickness or the rigidity of the material with which the tubular element 61 is made.

As mentioned above, like the sheet 70, the sheet 60 is a sheet made of flexible material having a welding surface and a non-welding surface. In the particular example shown in the drawing, the welding surface is the one external to the tubular element 61 that therefore forms the outer surface of the tubular element, while the non-welding surface is the inner one with respect to the tubular element 61.

As mentioned, each pair of rollers 66 positioned respectively above and below the plate 67 comprises two rollers 66, wherein one roller is configured so as to rotate in opposite direction with respect to the roller positioned above/below it.

Folding means 64 and 65 placed oblique to the conveying direction of the tubular element 61 shown in the drawing, are positioned at the end portion of the plate 67. The folding means 64 and 65 are positioned at the bottom with respect to the tubular element 61 so that the tubular element 61 may slide over them. As described below, it is possible to provide the end portion of the tubular element with an arrow structure by means of rotating the folding means 64 and 65 about the axis thereof.

Figure 7A:
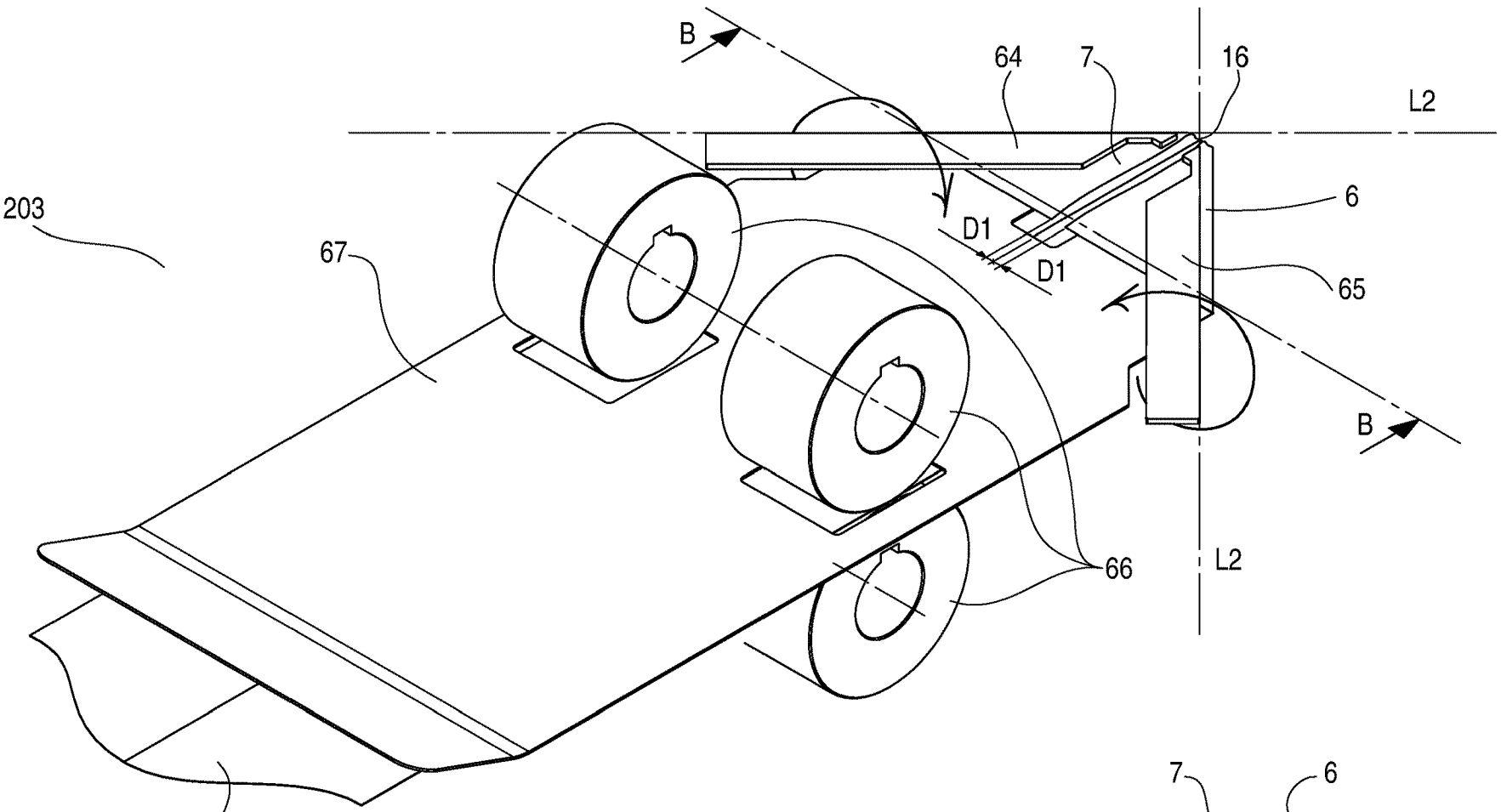
FIG. 7A shows the detail of the tubular element forming station shown in FIG. 6A, in a successive state, after an end portion of the tubular element was folded along fold lines that are inclined with respect to the axis of the tubular element.

Such folding means 64 and 65 are shown more clearly with reference to FIG. 7A. As shown, such means have a substantially rectangular shape. In particular, such folding means 64 and 65 have an inner edge having a form that deviates from the rectilinear one in the particular state shown in FIG. 7A (that is, after they have performed the rotation about the axis thereof, thus forming the arrow structure). Firstly, the central "pointed" end portion allows optimizing the folding process. Otherwise, the cavity positioned at the central end portion of the folding means 64 and 65 allows securing the fold by means of welding, as will be more apparent when the welding means 44 are described.

In particular, the fold of the end portion of the tubular element 61 is ensured by the joint operation carried out by the folding means 64 and 65 and by the inclined edges 67*a* of the end edge of the plate 67 that have a similar shape to the one of the folding means 64 and 65.

In particular, the end edge of the plate 67 has two portions 67*a* that are inclined with respect to the axis of the tubular element 61 and are symmetrical with respect thereto. Such inclined portions 67*a* substantially are arranged parallel to the folding means 64 and 65. In addition, the end edge of the plate 67 has a substantially rectangular opening 67*b* positioned at the axis of the tubular element 61.

Therefore, when the tubular element 61 that slides below the plate 67 arrives close to the end portion of the plate 67, it will be visible at the central rectangular portion 67*b* of the plate 67. This configuration is advantageous because it is possible to seal the triangular portions 6, 7 of the tubular element 61 to the tubular element 61 itself, at the rectangular opening 67*b*, after the fold was made by the folding means 64 and 65 with the aid of the inclined edges 67*a* of the plate 67. As described above, the access to the rectangular portion 67*b* is also ensured by the particular shape of the end portion of the folding means 64 and 65.

As shown in FIG. 7A, by rotating the folding means 64 and 65 about the axis thereof, they rotate an end portion of the tubular element 61 so as to form two triangular portions 6, 7 placed symmetrically opposite to the axis of the tubular element 61. After the fold is made, the two right-angled triangles 6 and 7 that were formed and that in essence are the folds of the tubular element 61, are at a predetermined distance that is equal to twice the distance D1 that was described with reference to FIG. 1.

In this manner, an end portion of the tubular element having a substantially trapezoidal shape, therefore an upper base 16 equal to twice the predetermined distance D1, is formed by means of the fold of the end portion of the tubular element 61.

Figure 7B:
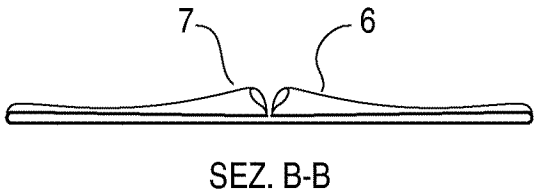
FIG. 7B instead shows a section view along the cutting line B-B shown in FIG. 7*a*, and in particular it shows a section view of the triangular portions 6 and 7.

FIG. 7B shows a section view along the cutting line B-B in FIG. 7A. As is shown in the section view, there are two triangular portions 6 and 7 that, after the fold is made, are not perfectly resting on the tubular element 61 itself due to the fact that the end portion of the plate 67 is comprised between the tubular element 61 and the triangular portions 6 and 7.

Figure 8:
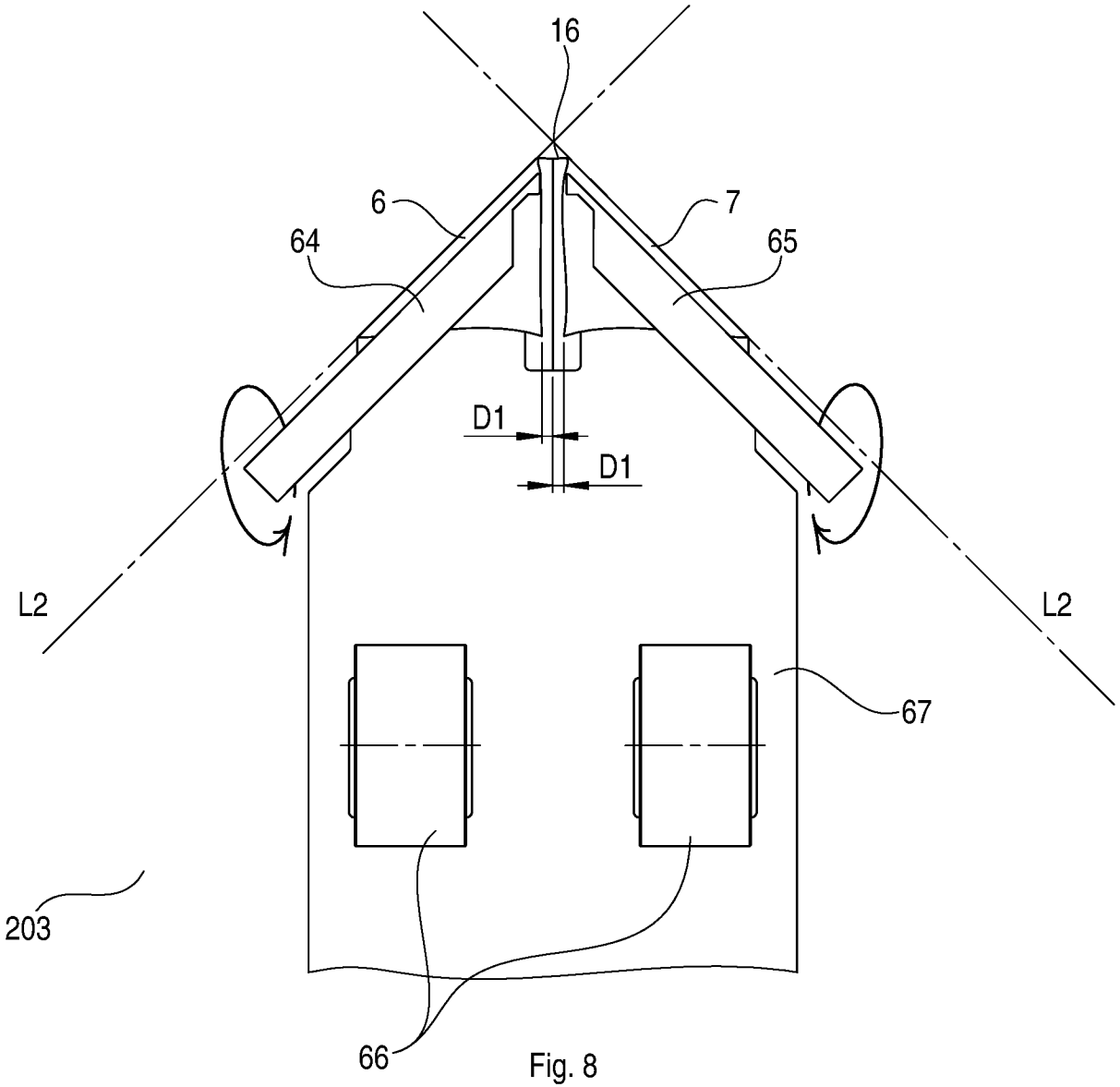
FIG. 8 shows a top view of the detail shown in FIG. 7A.

FIG. 8 clearly shows a top view of the state of the end portion of the tubular element 61 after the fold is made by means rotating the folding means 64 and 65 about the axis thereof, with the co-participation of the oblique end portion 67*a* of the plate 67 that allowed making the fold along the fold lines L2 that coincide with the inclination of the oblique end portion 67*a*.

Figure 9:
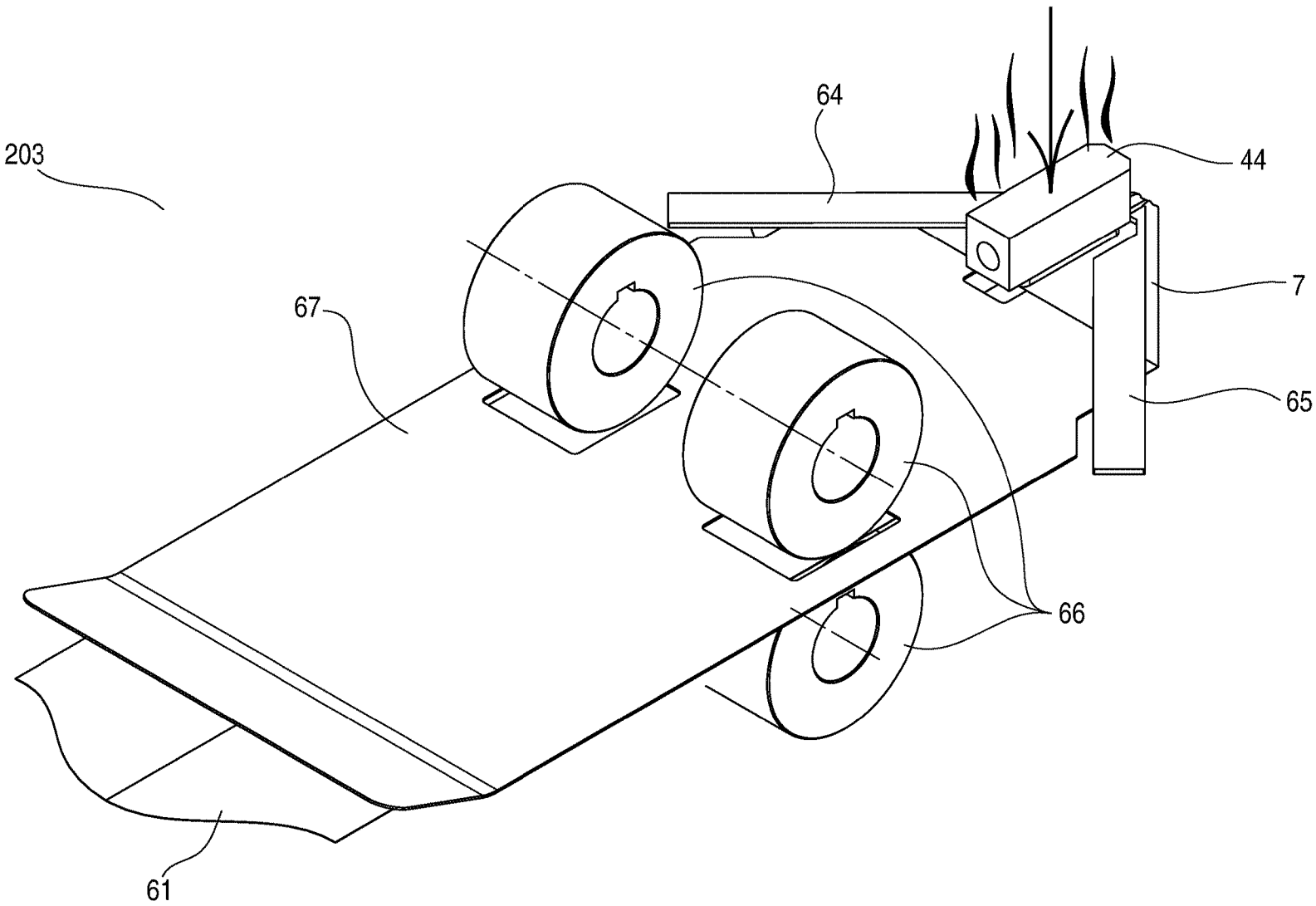
FIG. 9 shows a three-dimensional view of the detail shown in FIG. 7A, in a successive state after the triangular portions 6 and 7 were secured by means of welding the tubular element 61.

FIG. 9 shows a successive state with respect to the one shown in FIG. 8. A seal between the triangular portions 6 and 7 and the central portion of the tubular element 61 is made in this state due to the fact that the oblique portions 67*a* are placed at a given distance due to the rectangular opening 67*b*, as mentioned above. In this manner, it is possible to secure the triangular portions 6, 7 to the tubular element 61 itself so that the fold line L2 that was provided in the preceding step is kept following a successive movement of the tubular element 61.

Figure 10:
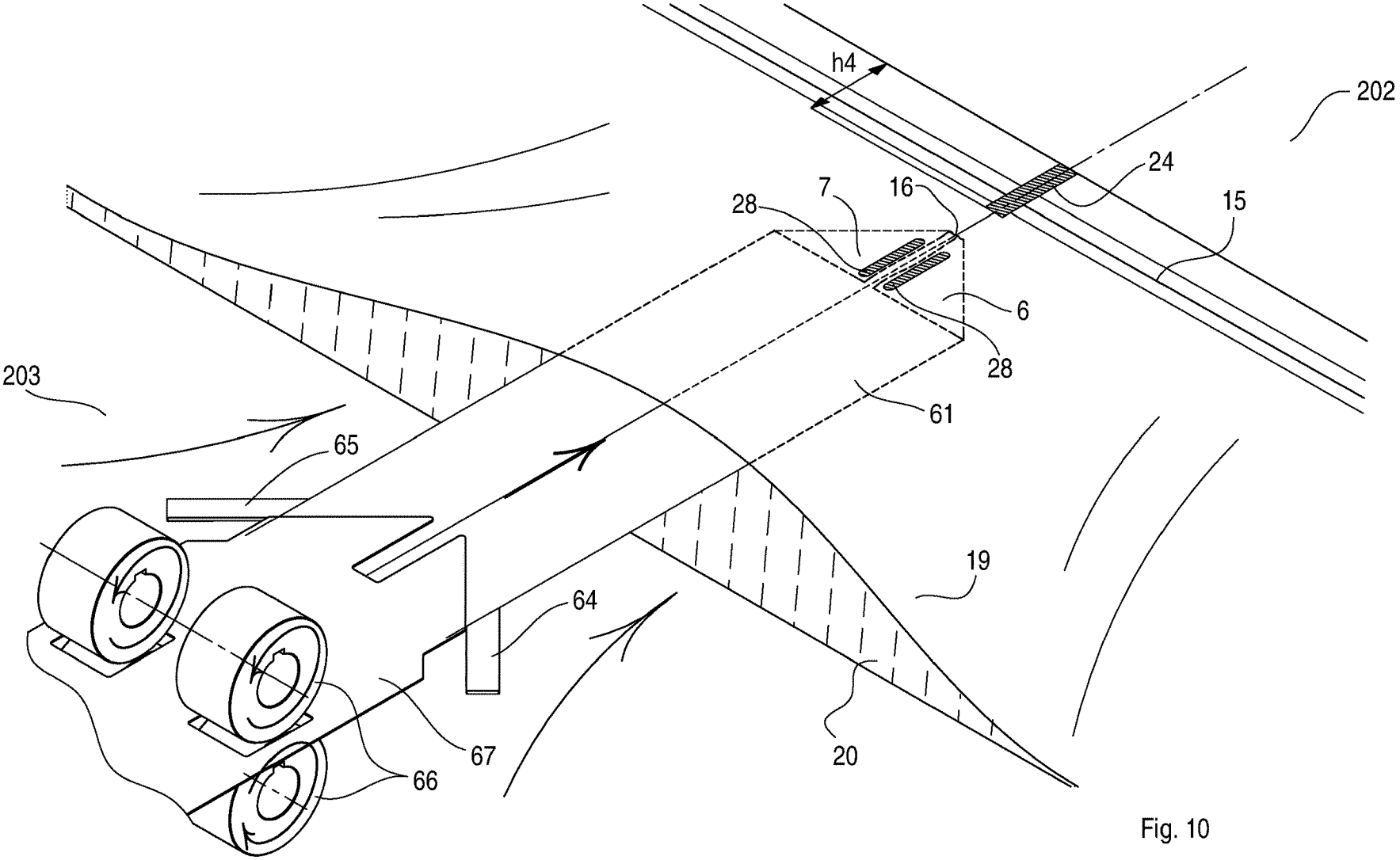
FIG. 10 shows a three-dimensional view of the tubular element forming station shown in FIG. 9, and of a coupling station wherein the tubular element is inserted between the sheets coming from the first station shown in FIG. 4.

In the particular example shown in the drawing, the welding means 44 allow welding the triangular portions 6 and 7 to the tubular element 61 by means of two seal stretches 28 that extend mutually parallel along the sides of the triangular portions 6, 7. In particular as shown in FIG. 10, each of the two seal stretches 28 seals respectively one of the triangular portions 6, 7 to the tubular element 61. However, it is apparent that the number of seal stretches 28 may vary, as the shape of such stretches may vary.

Alternatively, the triangular portions 6, 7 could also be "tacked" to the tubular element 61 by means of one or more circular seal spots positioned at the axis of the tubular element 61, wherein such seal spots preferably would allow simultaneously welding both triangular portions 6, 7 to the tubular element 61. Moreover, such shape of the tacking can also be other than circular, such as for example ellipsoid-shaped. However, it is apparent that such tack spots alternatively can also be made in side portions with respect to the axis of the tubular element 61.

Returning to FIG. 3, it was mentioned that the tubular element 61 is conducted into a portion comprised between the front sheet 19 and the back sheet 20 along a direction perpendicular to the conveying direction of the sheets 19 and 20. In addition, as shown in FIG. 10, the tubular element 61 is conveyed into the inner area between the sheet 19 and the sheet 20, at the welding surface 24 that was made before, so that the axis of the tubular element 61 coincides with the symmetry axis (perpendicular to the edges 19, 20) of the welding surface 24. This contrivance is important because in this manner, it is possible to make packages having a central symmetry axis.

As mentioned, the conveying of the tubular element 61 is ensured by the rotation means 66 that allow the insertion thereof into the portion comprised between the front sheet 19 and the back sheet 20. The tubular element 61 is inserted until the upper base 16 reaches a distance h2 with respect to the edge of the sheet 19, 20 that is opposite to the one 37, 38 at which the tubular element 61 was inserted.

The distance h2 preferably is in the range of tens of a millimetre, for example greater than or equal to 40 mm, more preferably greater than or equal to 50 mm. Such distance strongly depends on the sizes of the package 100. As described above with respect to the package 100, this distance h2 allows having the great advantage that an upper portion of the package 100 is free from gussets at which a reclosable opening 15 can be positioned.

After the tubular element 61 has reached such distance h2 from the opposite edge with respect to which it was inserted, the tubular element 61 is cut through cutting means 33 along the cutting line L3 placed at a distance D2 with respect to the lower edge of the package so as to separate a tubular element portion 69.

This distance D2 was already described above with reference to the package in FIG. 1 and as mentioned above, serves to allow effectively closing the side gussets 3, 4 within a lower welding surface 27. Therefore, the cutting means 33 are positioned between the front sheet 19 and the back sheet 20 to allow such cutting.

It is apparent that such cutting process of the tubular element 61, which allows separating the tubular element portion 69, may alternatively be performed before the tubular element itself is conveyed into the area comprised between the two sheets 19, 20. In this manner, there is no need to position the above-described cutting means 33 at the area comprised between the two sheets 19, 20. By way of example, such cutting means 33 can also be placed upstream of the area wherein the above-described fold of the end portion of the tubular element 61 is made. Here, the tubular element portion 69 is conveyed into the area comprised between the sheets 19 and 20 until the tubular element portion 69 reaches the distance h2 from the above-described edge and therefore, accordingly reaches the distance D2 from the edge at which such tubular element portion 69 is inserted.

Later, to allow securing the tubular element portion 69 cut beforehand to the front sheet 19 and the back sheet 20, a further welding surface 29 is made that allows welding the three components together. Such welding surface 29 can have various shapes.

Figure 11:
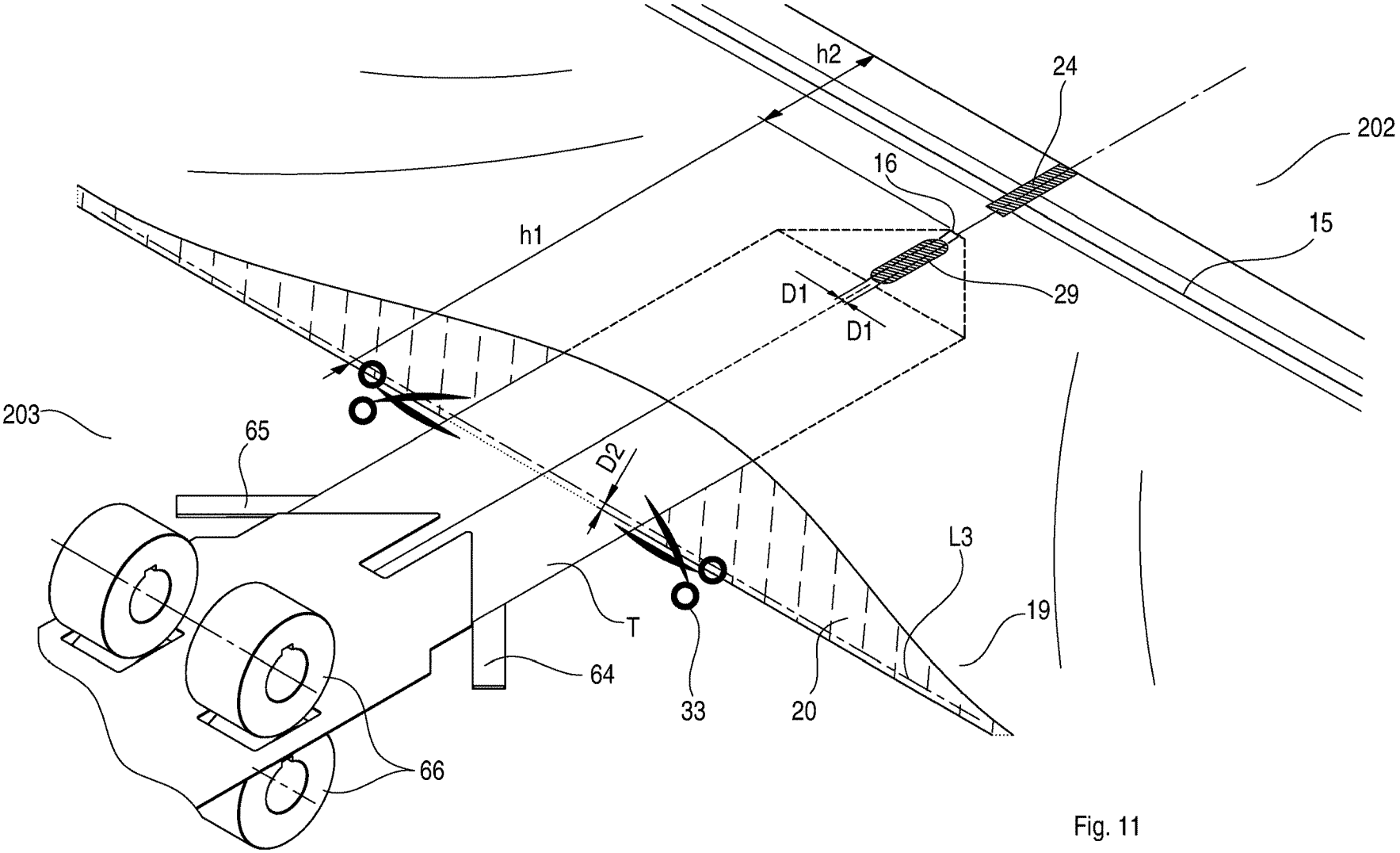
FIG. 11 shows a three-dimensional view of the stations depicted in FIG. 10, in a successive state, after the tubular element is cut along a cutting line.

In the particular example shown in FIG. 11, the seal is obtained by means of a welding surface 29 that circumscribes both the seal stretches 28 shown in FIG. 10. Here too, such welding could alternatively be obtained by means of one or more seal spots having for example, circular shape.

Moreover, further various shapes of welding surfaces may be obtained. For example, larger welding surfaces can also be applied, that also interact with the welding surface 24 made beforehand. For example, there could be a welding surface that extends along the direction perpendicular to the edge of the sheets 19, 20 and that circumscribes the whole welding surface 24.

Figure 12:
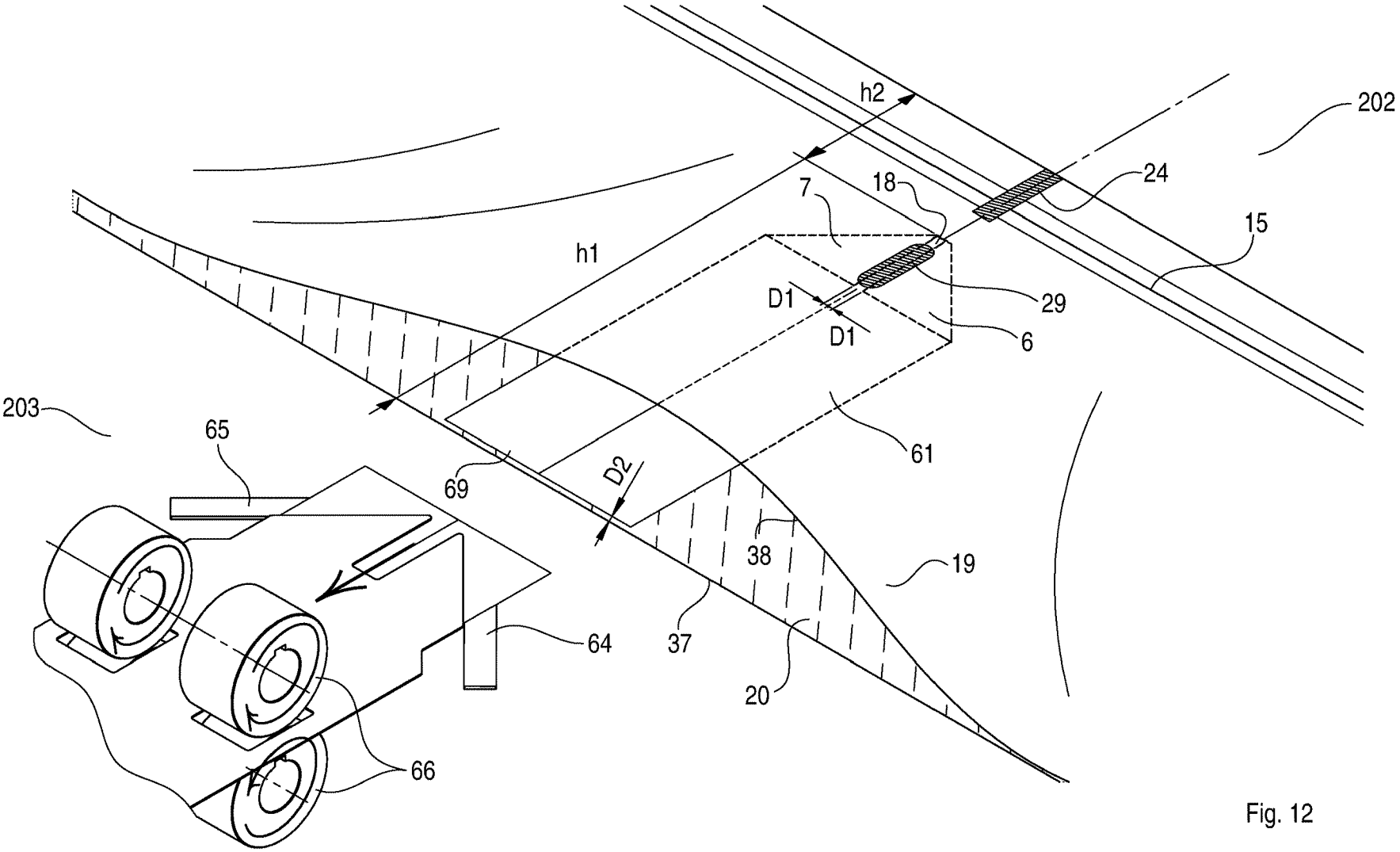
FIG. 12 shows a three-dimensional view of a successive state with respect to the one shown in FIG. 11.

After the tubular element portion 69 is secured to the front sheet and to the back sheet 19, 20 by means of welding, the tubular element 61 to which the tubular element portion 69 cut beforehand was secured, is brought back, following the direction shown by the arrow in FIG. 12. Such translation is ensured by the rotation of the rotation means 66 that rotate in the opposite direction with respect to what is described for example, in FIG. 10. It is apparent that such rotation of the rotation means 66 to cause the tubular element 61 to retract towards the folding means 64, 65 becomes necessary because the tubular element 61 was cut at the area comprised between the two sheets 19, 20. Such rotation described here is not necessary if the cutting means 33 are positioned at a given distance from the sheets 19, 20, for example upstream of the folding means 64 and 65.

Figure 13:
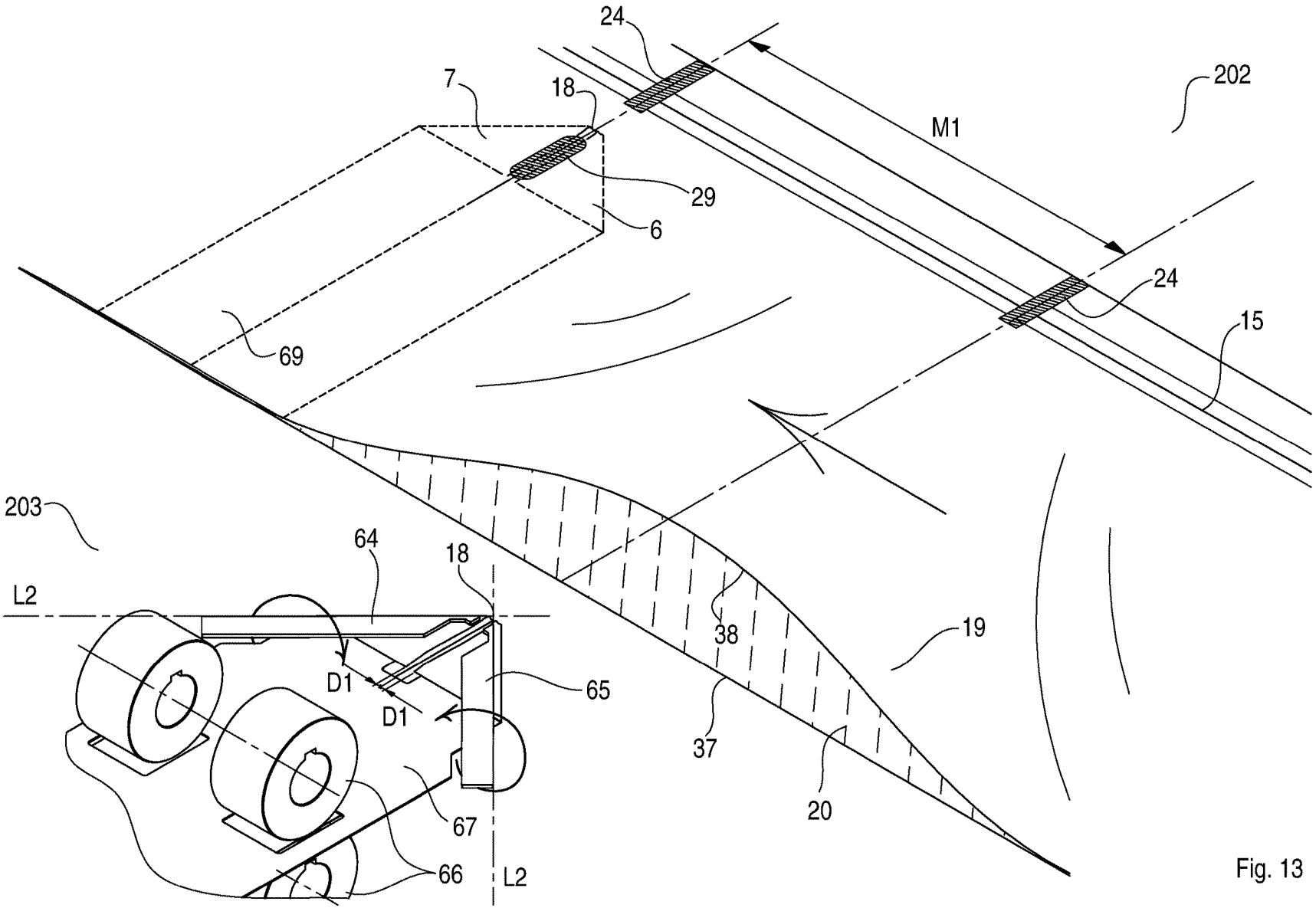
FIG. 13 shows a three-dimensional view of the detail shown in FIG. 12, in a successive state with respect to the one shown in FIG. 12.

In a successive step shown in FIG. 13, the folding means 64 and 65 make a new fold on the end portion of the tubular element 61 and in the same manner, the front and back sheets 19, 20 to which the tubular element portion 69 was sealed are caused to slide along the conveying line shown in the drawing, which allows reaching the successive stations that are described with reference to FIG. 14.

Figure 14:
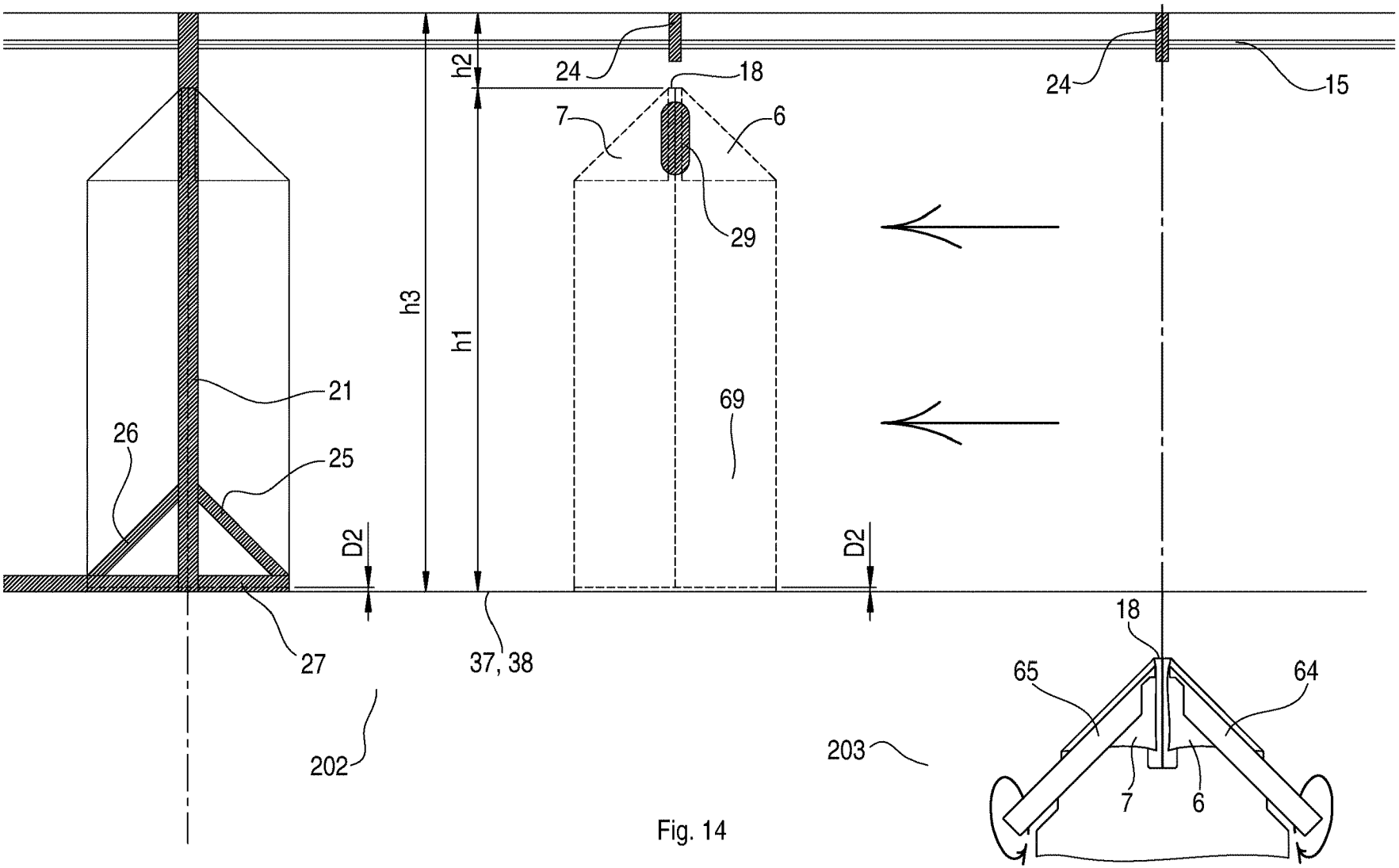
FIG. 14 shows a top view of the portion of machine shown in FIG. 13, showing the various seals made.

FIG. 14 indeed shows that the welding 21 that allows making the actual package 100 occurs in a successive section of the coupling station 202. Indeed, welding surfaces 21 are obtained perpendicular to the conveying direction, which form the side seals 22, 23 of the package 100, as described with reference to FIG. 1.

As shown, the welding surface 21 overlaps the welding surface 24 obtained by the welding grippers 43 and the welding surface 29 obtained to secure the tubular element portion 69 to the sheets 19, 20 so as to prevent the tubular element portion 69 from moving during a conveying towards the area of the machine wherein the welding surface 21 is obtained. In particular, the central axis of the welding surface 21 coincides with the central axis of the sealed surface 24.

As is apparent from the preceding description, the seal 21 has a width equal to twice the above-described distance D1, plus a predetermined quantity that will allow forming the triangular portions 6, 7 of the tubular element at the edges of the package 100.

Moreover, there are also formed the seals 27 for the lower closure of the package and the oblique seals 25 and 26 that as described above, allow preventing the content of the package to possibly remain in the corners of the package itself and to provide the package 100 with a flat bottom.

Figure 15:
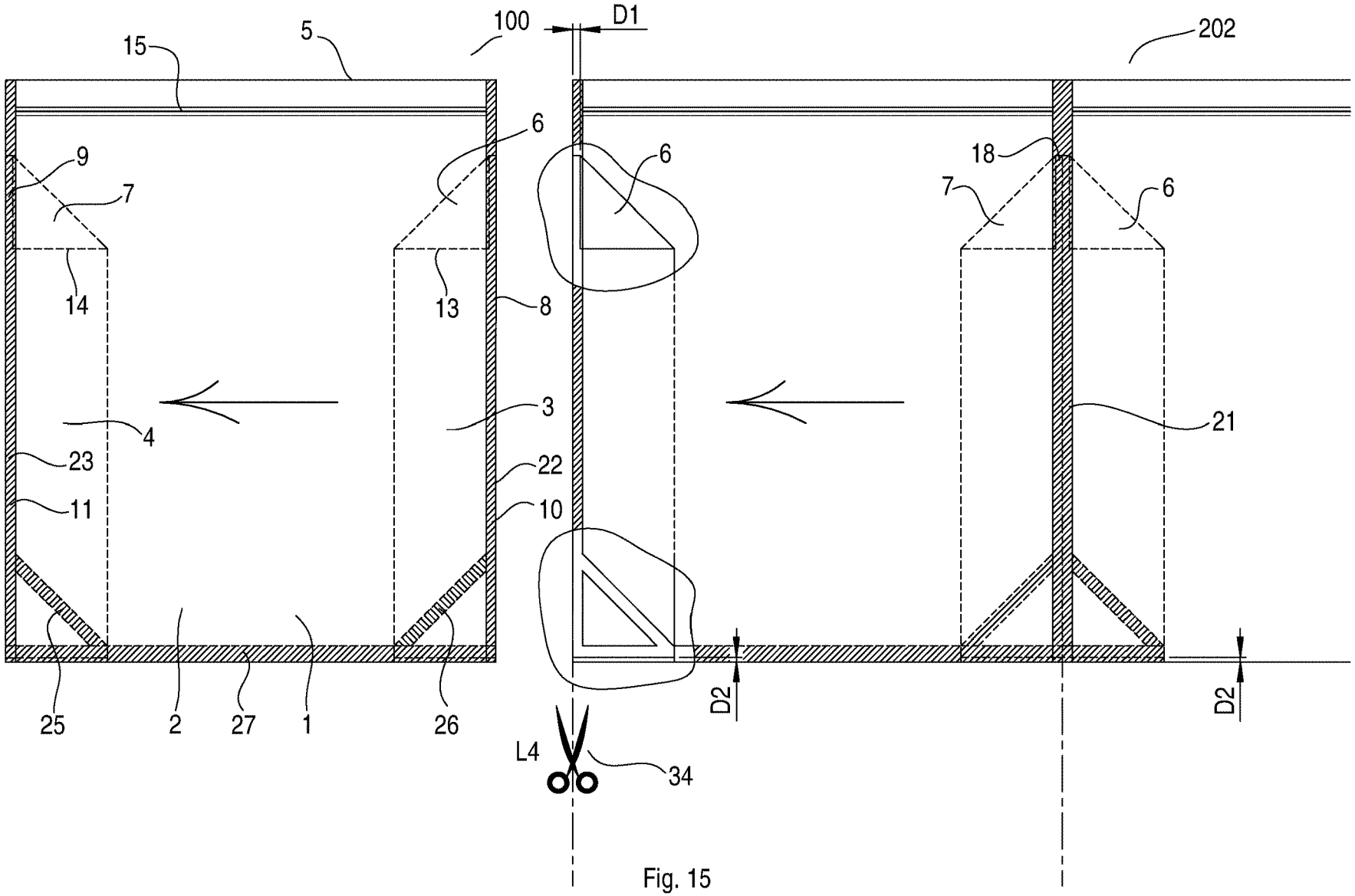
FIG. 15 shows a top view similar to the one shown in FIG. 14, which shows a successive state to the one shown in FIG. 14, that is when one package is separated from the following one.

In this manner as shown in FIG. 15, the package 100 is ready to be separated from the sheet itself so as to form a true package. Therefore, it is possible to separate the packages 100 from one another by making a cut along the cutting line L4 by means of the cutting means 34. The cutting line L4 is perpendicular to the conveying direction of the packages and divides the seal 21 into two perfectly equal parts.

Therefore, packages closed on three sides and having a reclosable opening 15 are produced downstream of the coupling station 202. The reclosable opening 15 preferably is in an open state, that is in a state wherein the first portion of the reclosable opening 15 positioned on the inner side of the front panel 1 is uncoupled from the second portion of the reclosable opening 15 positioned on the inner side of the back panel 2. In this manner, it is possible to provide packages 100 that are ready to be filled without the need to uncouple the first portion from the second portion of the reclosable opening 15, which could result in an increased waste of time.

Figure 16:
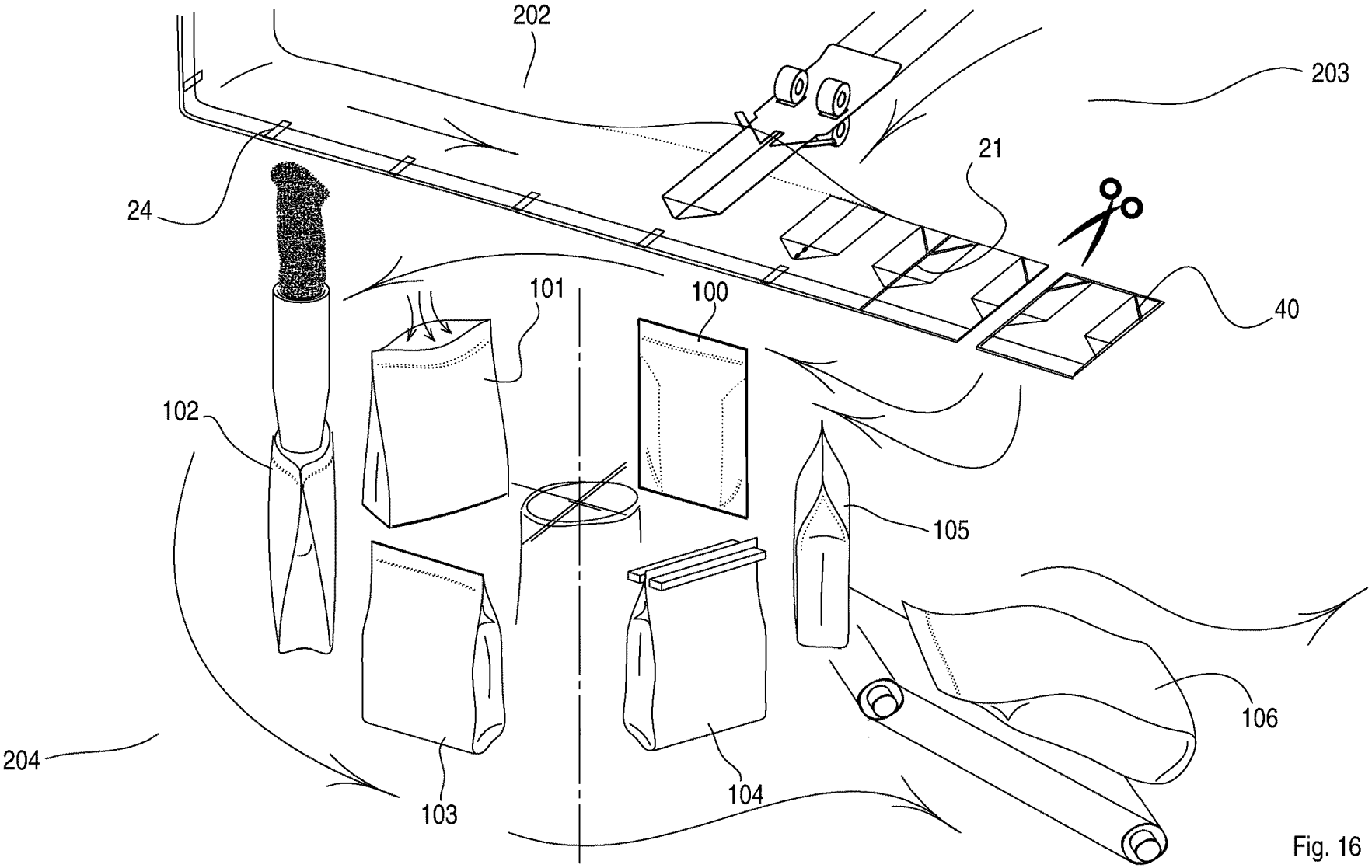
FIG. 16 shows a final state wherein the packages shown in FIG. 15 are brought into a closing station configured so as to fill the packages with product, close them and supply them to the outside.

As shown in FIG. 16, a carousel may be placed at this point that is configured so as to receive the packages 100 provided by the coupling station 202, to open them so as to insert the contents of the package through the opening 5 of the package 100.

For example as shown in the drawing, the package 100 is opened in a successive step, forming an open package 101, the open package 101 is then filled by means of a funnel, thus forming a filled package 102. The filled package 102 is then closed, forming a closed package 103 that is then sealed, thus forming the package 105 shown in the drawing that can then be provided to the outside.

It is worth noting that although the processes performed by the machine were described one following another to clarify the description, it is apparent that such processes normally are performed simultaneously so as to have a machine 200 that continuously produces packages. For example, the preparing station 201 can perform the operations described above while the tubular element forming station 203 makes the tubular element 61.

The term continuous here means a process that allows making packages one after another, thus with a temporal distance between making one package and the next. As explained by the example, the term "continuous" here therefore means that while one station performs a given process on a package, another station performs another process on another package, that is that each station preferably can work continuously.

The temporal distance between making two successive packages is due to the fact that the different steps are to be performed along the production line of the packages: from the various seals to the various folds.

Although the present invention was described with reference to the embodiments described above, it is apparent to an expert in the field that it is possible to make several modifications, variants and improvements to the present invention in light of the above teaching and within the scope of the appended claims, without departing from the object and the scope of protection of the invention.

For example, even if it has been described that the packages 100 have a reclosable opening, it is apparent that the present invention is also valid for packages that do not have a reclosable opening.

Moreover, even if it has been described in the description that the machine comprises four stations, it is possible to make a machine that contains only some of such stations. For example, the filling station 204 may be omitted in many cases wherein the production of packages and not the filling thereof, is required.

Even if it has been shown in each of the drawings that the preparing station 201 is a vertical station, it also is alternatively possible for such station to be a horizontal preparing station. Moreover, both with regards to the preparing station 201 and to the tubular element forming station 203, when reel is discussed, it means more generally any system capable of continuously providing a strip of sheet or a reclosable opening.

Finally, those fields known by experts in the field were not described to avoid excessively and uselessly overshadowing the invention described.

Accordingly, the invention is not limited to the embodiments described above, but is only limited by the scope of protection of the appended claims. what is claimed is:

What is claimed is:

1. A method for making packages made of flexible material; said method comprising the following steps:

a. providing a first strip and a second strip made of flexible material, positioned on top of each other along a conveying direction and having a width;

b. securing said first strip to said second strip by a welding surface which extends in a direction perpendicular to said conveying direction of said first and said second strip for a first length which is less than the width of each of said first and said second strip, said welding surface being positioned at a first side edge of said first and said second strip wherein after said first strip has been secured to said second strip by said welding surface, a second side edge of said first strip and a second side edge of said second strip, which are opposite to said first side edge, are moved away from each other so as to form an empty space comprised between said first strip and said second strip which extends from said second edge to said welding surface;

wherein said method further comprises the following step:

c. conveying a tubular element which will form side gussets of said package into said empty space up to an end portion of said tubular element reaching a first distance from said first side edge, wherein said first distance is greater than or equal to said first length; wherein said tubular element is conveyed along a direction perpendicular to said conveying direction of said first and said second strip.

2. A method according to claim 1, wherein a distance between two midpoints of two of said welding surfaces, which are positioned consecutively along said conveying direction, is equal to the width of said package, said distance being measured along said conveying direction.

3. A method according to claim 1, wherein an edge of said welding surface is positioned along said first side edge of said first and said second strip.

4. A method according to claim 1, wherein said first length, along which said welding surface extends, is less than half the width of said first strip and said second strip, said first length being comprised between 35 mm and 50 mm.

5. A method according to claim 1, wherein in said step a), said first and said second strip are made from a third strip coming from a reel, wherein said first and said second strip are obtained by folding said third strip coming from the reel along a fold line coinciding with an axis of said third strip, so as to arrange side edges of said third strip at each other, and cutting said third strip along said fold line.

6. A method according to claim 1, wherein said method further comprises the following step:

d. providing a reclosable opening between said first strip and said second strip so as to position said reclosable opening along a direction parallel to said conveying direction at a distance from said first edge which is less than said first length, so as to secure said reclosable opening between said first strip and said second strip by said welding surface.

7. A method according to claim 1, wherein said tubular element is made by folding a sheet made of flexible material along two first fold lines that are mutually parallel so as to form a tubular element, and by folding an end portion of said tubular element along two second fold lines that are oblique with respect to the direction of said two first fold lines so as to form an end portion of said tubular element that has two triangular portions having two mutually parallel sides.

8. A method according to claim 1, wherein after said tubular element is conveyed into said empty space between said first strip and said second strip, said tubular element is secured to said first strip and to said second strip by a second welding surface.

9. A machine for making packages made of flexible material; said machine comprising a preparing station configured so as to provide a first strip and a second strip positioned on top of each other along a conveying direction; wherein said preparing station comprises:

a first welding device configured so as to make a welding surface which extends in a direction perpendicular to said conveying direction of said first and said second strip for a first length which is less than the width of each of said first and said second strip, said welding surface being positioned at a first side edge of said first and said second strip;

said machine further comprising:

a separating device positioned downstream of said first welding device and configured so as to move a second side edge of said first strip and a second side edge of said second strip, which are opposite to said first side edge, away from each other so as to form an empty space comprised between said first strip and said second strip which extends from said second edge to said welding surface;

a conveyor configured so as to convey a tubular element which will form side gussets of said package into said empty space up to an end portion of said tubular element reaching a first distance from said first side edge, wherein said first distance is greater than or equal to said first length.

10. A machine according to claim 9, wherein said first length is less than half the width of said first strip and said second strip, said first length being comprised between 35 mm and 50 mm.

11. A machine according to claim 9, wherein said preparing station further comprises:

a folding device configured so as to fold a third strip coming from a reel along a fold line which coincides with an axis of said third strip so as to arrange the side edges of said third strip at each other;

a cutting device configured so as to cut said third strip along said fold line so as to allow obtaining said first and said second strip.

12. A machine according to claim 9, wherein said preparing station further comprises:

a second welding device configured so as to seal a reclosable opening to said first and said second strip, said second welding device being positioned at said first edge along a direction parallel to said conveying direction.

13. A machine according to claim 12, wherein said second welding device is positioned upstream of said first welding device.

14. A method of making packages from strips of flexible material comprising the steps of:

placing a first strip and a second strip of flexible material having a width and longitudinal edges on top of each other along a conveying direction parallel to the longitudinal edges;

attaching the first strip to the second strip along a first attachment length extending in a direction along the width of the first and second strips extending from one of the longitudinal edges of the first and second strips;

separating the first strip from the second strip forming a space along a portion of an opposing longitudinal edge from the one of the longitudinal edges of the first and second strips and opposite the first attachment length;

inserting a tubular element having a distal end into the space between the first and second strips wherein the distal end of the tubular element is adjacent the first attachment length;

folding the distal end of the tubular element forming two adjacent triangles separated by a longitudinal extent of the tubular element;

attaching the tubular element to the first and second strips along the longitudinal extent of the tubular element forming a second attachment length;

attaching the opposing longitudinal edge of the first and second strips together; and cutting the first and second strips along a cut line extending through the first attachment length and the second attachment length, whereby packages having gussets are formed from the strips of flexible material.

* * * * *